US008485603B2

(12) United States Patent
Albecker

(10) Patent No.: US 8,485,603 B2
(45) Date of Patent: Jul. 16, 2013

(54) LOOSE FILL CUSHIONS HAVING INTERNAL SUPPORT MEMBER

(76) Inventor: Walter Albecker, Chicago, IL (US)

( * ) Notice: Subject to any disclaimer, the term of this patent is extended or adjusted under 35 U.S.C. 154(b) by 403 days.

(21) Appl. No.: 12/661,210

(22) Filed: Mar. 12, 2010

(65) Prior Publication Data

US 2011/0221256 A1 Sep. 15, 2011

(51) Int. Cl.
*A47C 7/40* (2006.01)

(52) U.S. Cl.
USPC ..... 297/284.4; 297/452.32; 5/633; 5/657

(58) Field of Classification Search
USPC ..... 297/284.4, 284.6, 452.17, 452.32, 297/452.37; 5/633, 654, 655.4, 657, 911, 5/948

See application file for complete search history.

(56) References Cited

U.S. PATENT DOCUMENTS

| | | | | | |
|---|---|---|---|---|---|
| 3,495,871 | A * | 2/1970 | Resag et al. | ..... | 297/284.2 |
| 4,171,549 | A * | 10/1979 | Morrell et al. | ..... | 5/632 |
| 4,555,137 | A * | 11/1985 | Goldner | ..... | 297/284.7 |
| 4,577,358 | A * | 3/1986 | Glass | ..... | 297/452.17 |
| 4,718,724 | A * | 1/1988 | Quinton et al. | ..... | 297/284.5 |
| 4,835,801 | A * | 6/1989 | Walpin et al. | ..... | 5/652 |
| 5,314,235 | A * | 5/1994 | Johnson | ..... | 297/284.5 |
| 5,407,248 | A * | 4/1995 | Jay et al. | ..... | 297/284.1 |
| 5,474,362 | A * | 12/1995 | Albecker, III | ..... | 297/452.32 |
| 2004/0174056 | A1 * | 9/2004 | Gryp et al. | ..... | 297/284.6 |

* cited by examiner

*Primary Examiner* — Peter Brown

(57) ABSTRACT

A number of variations of loose fill (1) cushions having at least one stabilizer (3) to keep an internal lumbar support (2) in the proper position and alignment. Additionally, some embodiments are shown with a fin 4 above the lumbar support to provide further alignment stability.

19 Claims, 27 Drawing Sheets

LOOSE FILL CUSHIONS HAVING INTERNAL SUPPORT MEMBER

BACKGROUND

1. Field of Invention

This invention relates to cushions, and specifically to loose fill cushions designed to provide ergonomic back or seat support.

2. Discussion of Prior Art

Over the years, numerous methods for making chairs and sofas ergonomically supportive have been developed. Most methods involve contouring the face of the backrests, or adding pillows to the outside. U.S. Pat. No. 5,474,362 to the present inventor provides a way to provide a firm lumbar support in foam cushions without affecting the aesthetics of the cushion. This method calls for a cavity in a foam cushion to be filled with a firm lumbar support. However, this method does not lend itself to providing lumbar support in most loose fill type cushions. The problem is that though a foam cushion with a cavity provides a way to suspend the firm lumbar support within the cushion, without such a foam cushion with a cavity, positioning a lumbar support in a loose fill cushion would result in the lumbar support floating around the cushion, and as a result, the lumbar support would no longer be in the correct position for optimal back support in all axis. Thus, the lumbar support might shift to be too far to the front or back, too high or low, or skewed rotationally so that part of the lumbar support may be too far toward the front while the other is too far toward the back, or one part is high while the other part is low, or the alignment of the lumbar support may be improper, thus the top of the lumbar support may tilt toward the back while the bottom may tilt toward the front.

The primary advantage of the present invention over the prior art, is that it provides a way to provide lumbar support in a loose fill cushion, and does so by enabling the lumbar support to be suspended within the loose fill cushioning material, and to maintain the proper position and alignment within the cushion for optimal comfort and support to someone leaning against the cushion.

OBJECTS AND ADVANTAGES OF INVENTION

Accordingly several objects and advantages of the present invention are:

(a) To provide loose fill cushions with a simple, easy to manufacture lumbar support.

(b) To provide an economical way to make loose fill cushions ergonomically supportive.

(c) To provide a way to suspend a lumbar support in loose fill cushions in the proper position and alignment.

(d) To provide ergonomic support in loose fill cushions without changing the outer appearance of the cushion. This includes making the cushion without any supports for the lumbar support showing.

Further objects and advantages of my invention will become apparent from a consideration of drawings and ensuing descriptions of it.

DESCRIPTION OF INVENTION

In this invention, loose fill 1 refers to feathers, down, Dacron, polyester, shredded foam, cotton, fiberfill, batting, wadding, vegetable fibers, kapok, flock, animal fibers, etc. Foam refers to polyurethane or other elastic foam such as would be suitable for use in cushioning for chairs and the like. Though not shown in any of the figures, it is assumed that the loose fill material 1 may be covered with either some kind of ticking or other cover, and then covered with some kind of upholstery material—though it is not necessary that there be any material in addition to the upholstery material. Also, unless otherwise referred to, the stabilizers 3 and lumbar supports 2 are made of an elastic cushioning material such as polyurethane foam.

Figure 1A:
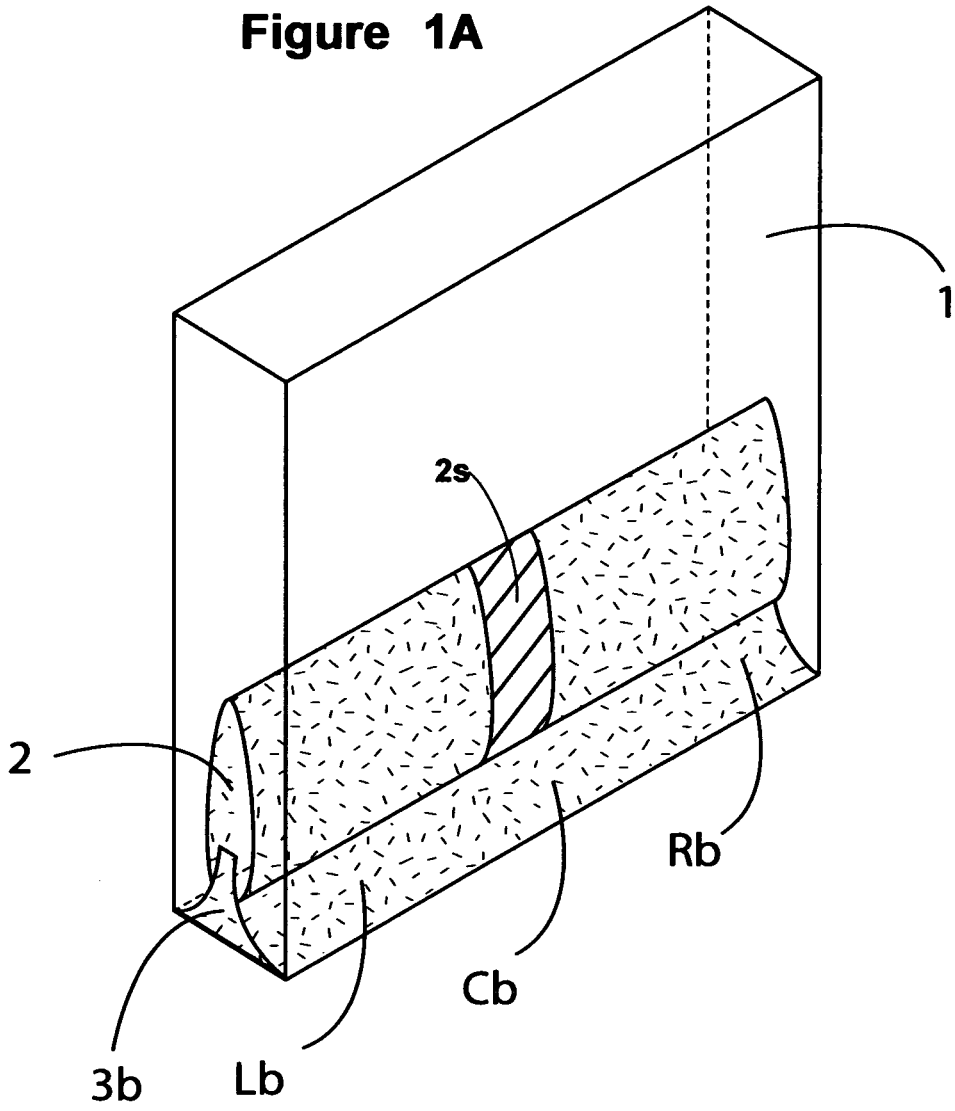
FIG. 1A is an isometric view of a cushion of a typical embodiment of the present invention, with a base stabilizer under the lumbar support.

FIG. 1A shows an isometric view of a cushion of a typical embodiment of the present invention, with a base stabilizer 3*b* under the lumbar support 2. Though not necessary, the lumbar support 2 is shown with a softer piece of foam in the center 2*s*, to minimize pressure on the spine of someone sitting on it. This is an option, and it is not necessary for the invention, and continuous lumbar support made of firm resilient material is also suitable. Also, given the various properties of foam, especially high density foams which in some instances can provide both softness and support, various options can be considered to provide both the support, as well as the comfort without including a softer piece in the middle. The cushion is filled with a loose fill material 1. As shown, the lumbar support 2 is attached to the base stabilizer 3*b* with a tongue and groove joint, which is glued. The lumbar support 2 can also be integral and continuous with the base support 3*b*. Whether integral and continuous or not, the lumbar support 2 and the base stabilizer 3*b* are secured to one another. As shown, the base support 3*b* is concave toward the front and back of the cushion. In a preferred embodiment, the base support would be made from relatively firm foam, possibly having an IFD (Indentation Load Deflection) of about 50 pounds. The concave shape is intended to not interfere with the sacrum of person leaning against the backrest.

The base stabilizer 3*b* helps maintain the lumbar support 2 at the right height, position, and alignment while someone leans against the cushion. Also, the dynamic nature of loose fill materials will cause the loose fill materials to be somewhat displaced during use, and then generally return to approximately an appropriate location after pressure is removed. The loose fill material is contained within the upholstery, and thus though it is displaced somewhat during use, the shape of the cushion upholstery helps it return to a reasonable shape.

Also shown in the drawing is the left base Lb, center base Cb, and right base Rb shown for reference. The left base Lb is on the left of the cushion, and the other elements are in their obvious respective positions.

Figure 1B:
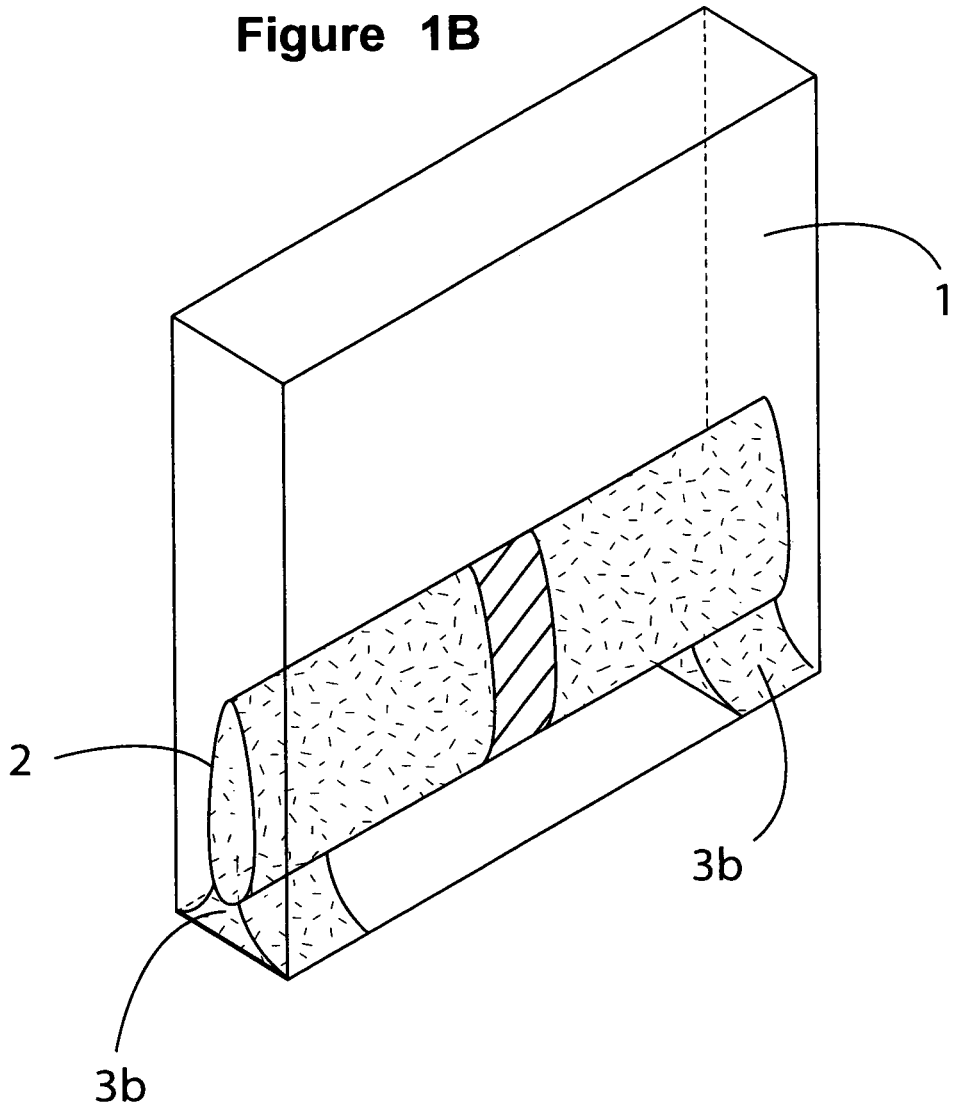
FIG. 1B is an isometric view of a cushion of a typical embodiment of the present invention, with two base stabilizers under the lumbar support.

FIG. 1B shows an isometric view of a cushion of a typical embodiment of the present invention, with two base stabilizers 3*b* under the lumbar support 2. This is similar to the embodiment shown in FIG. 1A, but below the lumbar support 2 is open toward the middle.

Figure 1C:
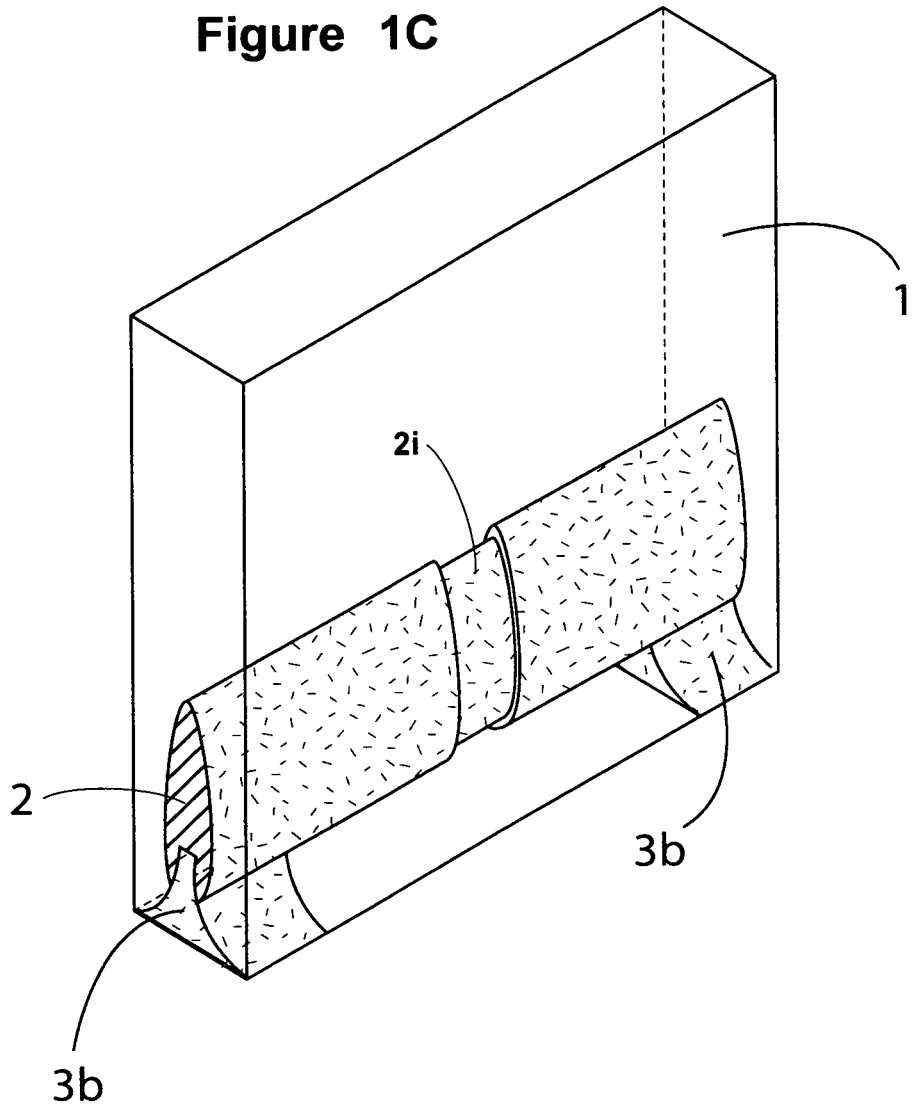
FIG. 1C is an isometric view of a cushion of a typical embodiment of the present invention, with two base stabilizers under the lumbar support similar to FIG. 1B, but with the lumbar support having an indentation in the middle.

FIG. 1C shows an isometric view of a cushion of a typical embodiment of the present invention, with two base stabilizers 3*b* under the lumbar support 2 similar to FIG. 1B, but with the lumbar support having an indentation 2*i* in the middle. Though inventor does not wish to be bound by this, a possible advantage of the solid lumbar support with the indentation 2*i* in a loose fill application, as compared with the lumbar support with the soft middle 2*s*, is that the solid lumbar support might have less flexibility, and thus provide more support than the lumbar support with the soft center 2*s*, this might be especially true when the base stabilizers do not extend substantially the width of the lumbar support. As indicated under FIG. 1A, the lumbar support can be made without the indentation 2*i*.

Figure 1D:
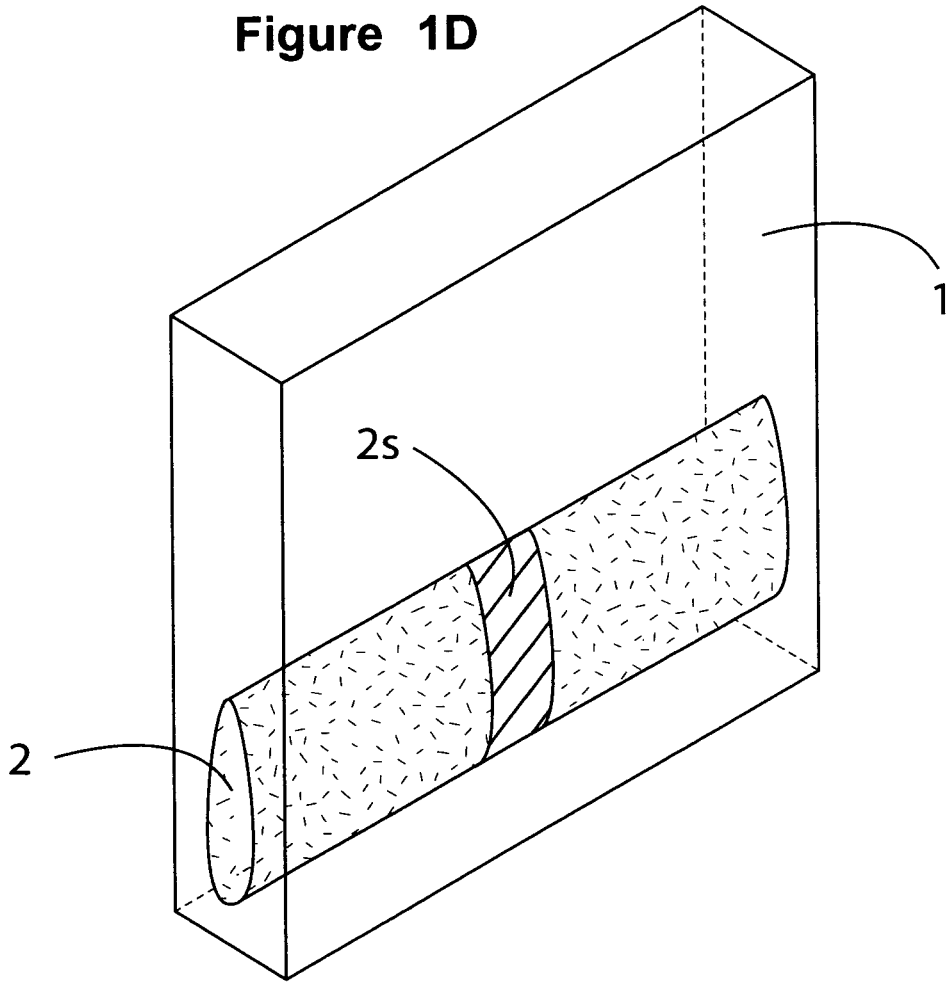
FIG. 1D is an isometric view of a cushion of with a lumbar support placed in a soft fill cushion without the type of stabilizer provided for in this invention.

FIG. 1D shows an isometric view of a loose fill cushion with a lumbar support placed in a soft fill cushion without the type of stabilizer provided for in this invention.

Figure 1E:
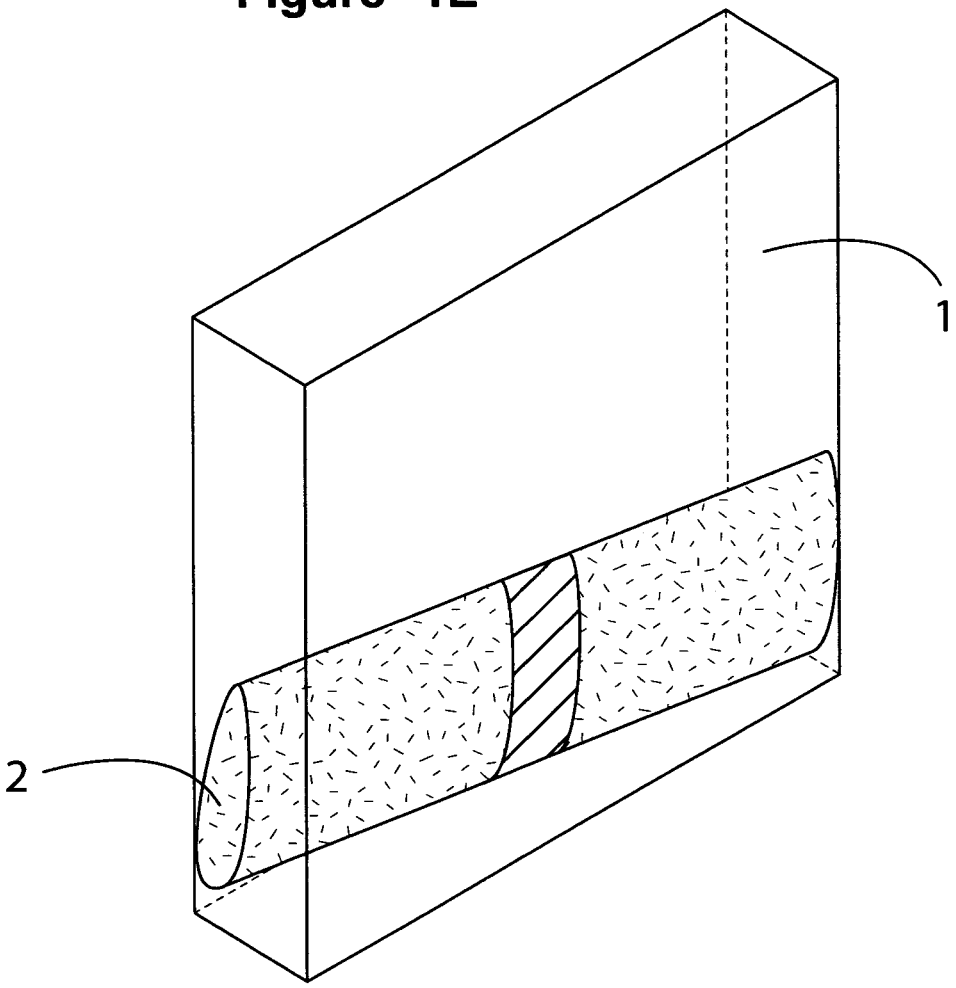
FIG. 1E is an isometric view of a cushion of with a lumbar support placed in a soft fill cushion without the type of stabilizer provided for in this invention, with the lumbar support skewed as might happen without the stabilizer(s) of the present invention.

FIG. 1E shows an isometric view of a loose fill cushion with a lumbar support placed in a soft fill cushion without the type of stabilizer provided for in this invention, with the lumbar support skewed as might happen without the stabilizer(s) of the present invention.

Figure 1F:
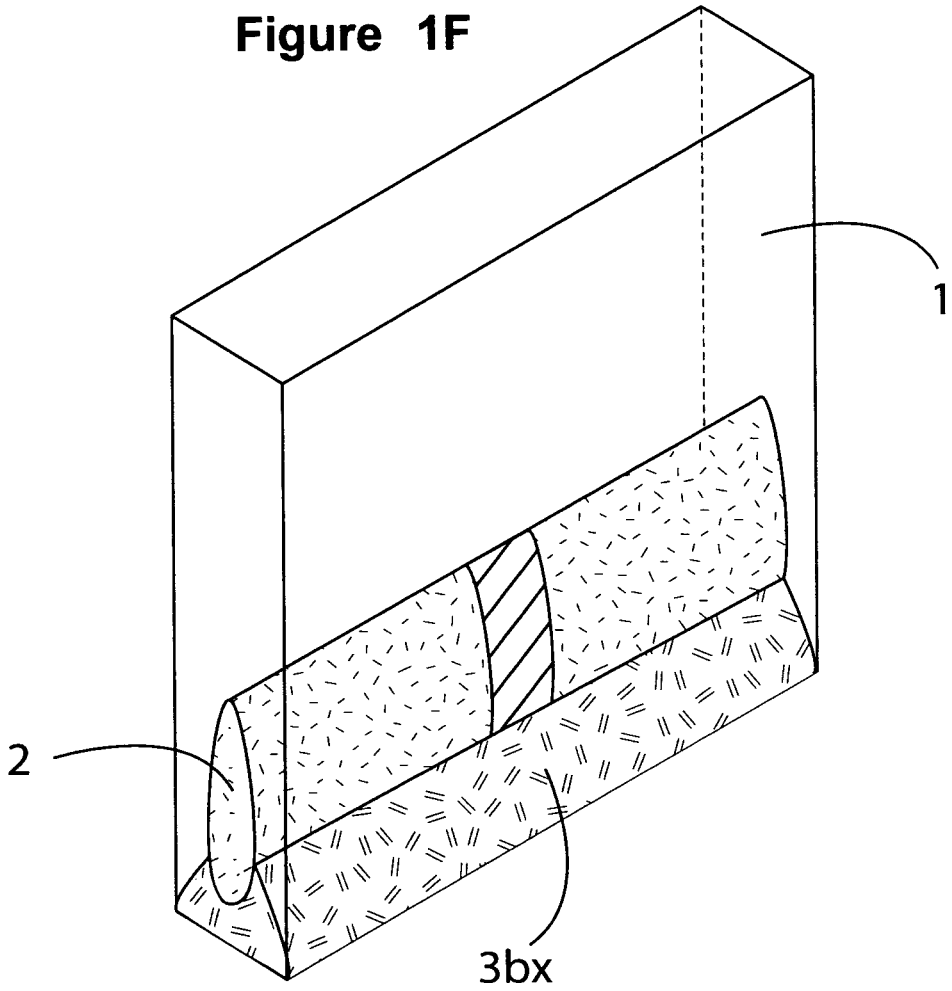
FIG. 1F is an isometric view of a cushion of a typical embodiment of the present invention with a convex base stabilizer under the lumbar support.

FIG. 1F is an isometric view of a cushion of a typical embodiment of the present invention with a convex base stabilizer under the lumbar support. Whereas the concave type base stabilizer referred to above, in a preferred embodiment, would be relatively firm, the convex base stabilizer 3*b* shown in this preferred embodiment can be relatively soft. There are two reasons for the convex base stabilizer 3*bx* for being relatively soft. First, the relatively soft base stabilizer 3*bx* compresses easily due to pressure from the lower back of a person leaning against the cushion, and the firmer lumbar support 2 helps the person maintain proper posture with a relatively natural lordotic curve. The softness of the base stabilizer 3*bx* may be similar to that of soft loose fill material, and thus as shown it can be somewhat convex without interfering with the user's sacral curve. Various foams, especially high density foams can provide the necessary support, and yet still be relatively soft.

Figure 1G:
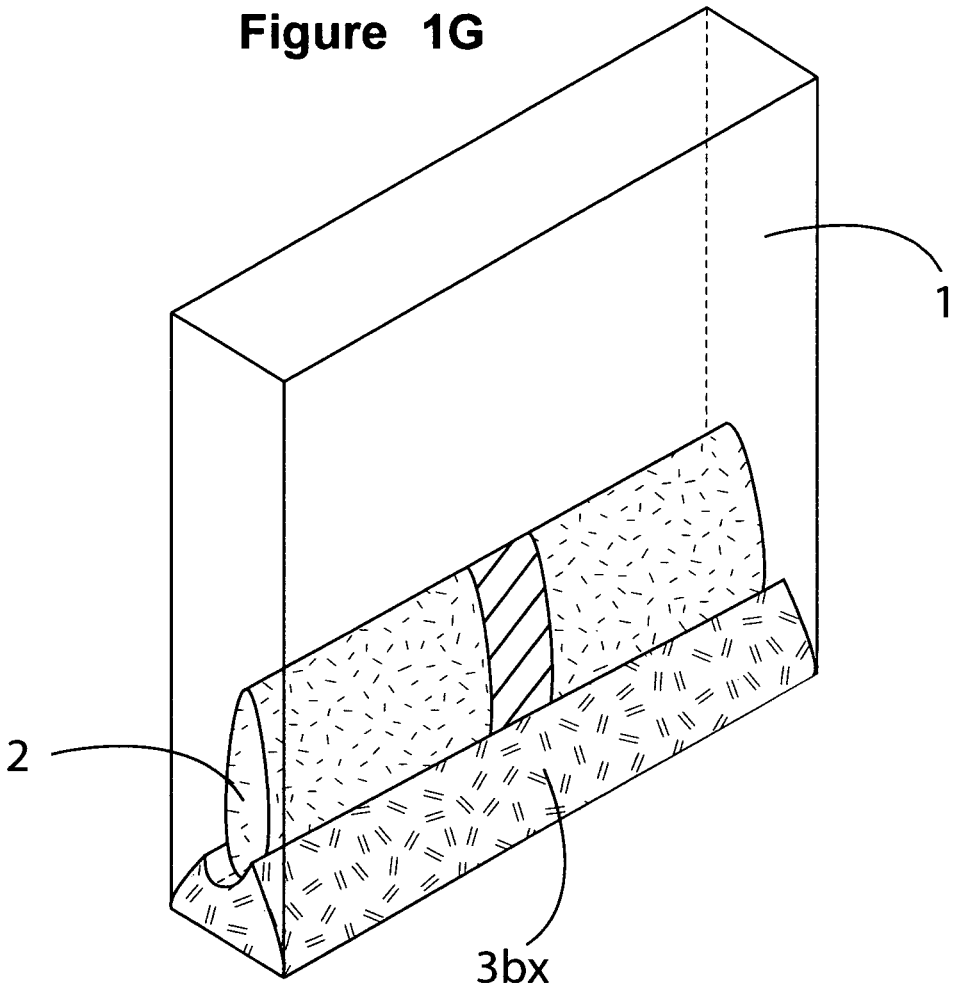
FIG. 1G is an isometric view of a cushion of a typical embodiment of the present invention with a convex base stabilizer under the lumbar support, and where the lumbar support is shorter than the convex base stabilizer.

FIG. 1G is an isometric view of a cushion of a typical embodiment of the present invention with a convex base stabilizer 3*bx* under the lumbar support 2, and where the lumbar support 2 is shorter than the convex base stabilizer 3*bx*. The purpose of making the lumbar support 2 shorter, is to reduce the possibility of the lumbar support showing through on the upholstery, which is not shown but assumed. This is mainly for aesthetic reasons.

Figure 1H:
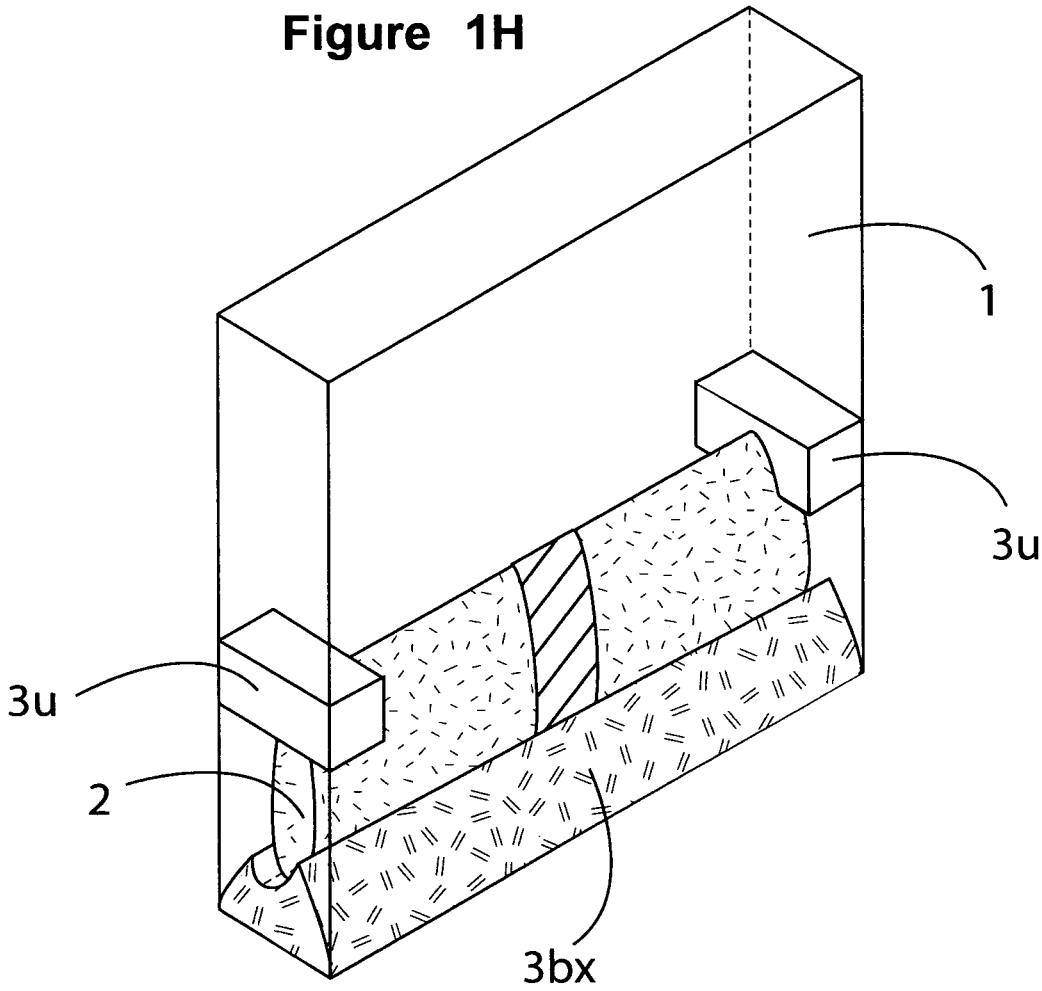
FIG. 1H is an isometric view of a cushion of a typical embodiment of the present invention with a convex base stabilizer under the lumbar support and two upper stabilizers to prevent tilting of the lumbar support.

FIG. 1H is an isometric view of a cushion of a typical embodiment of the present invention with a convex base stabilizer 3*bx* under the lumbar support 2 and two optional upper stabilizers 3*u* to prevent tilting of the lumbar support 2. These are relatively soft, but provide additional stabilization to maintain the lumbar support 2 in the proper alignment.

Figure 1I:
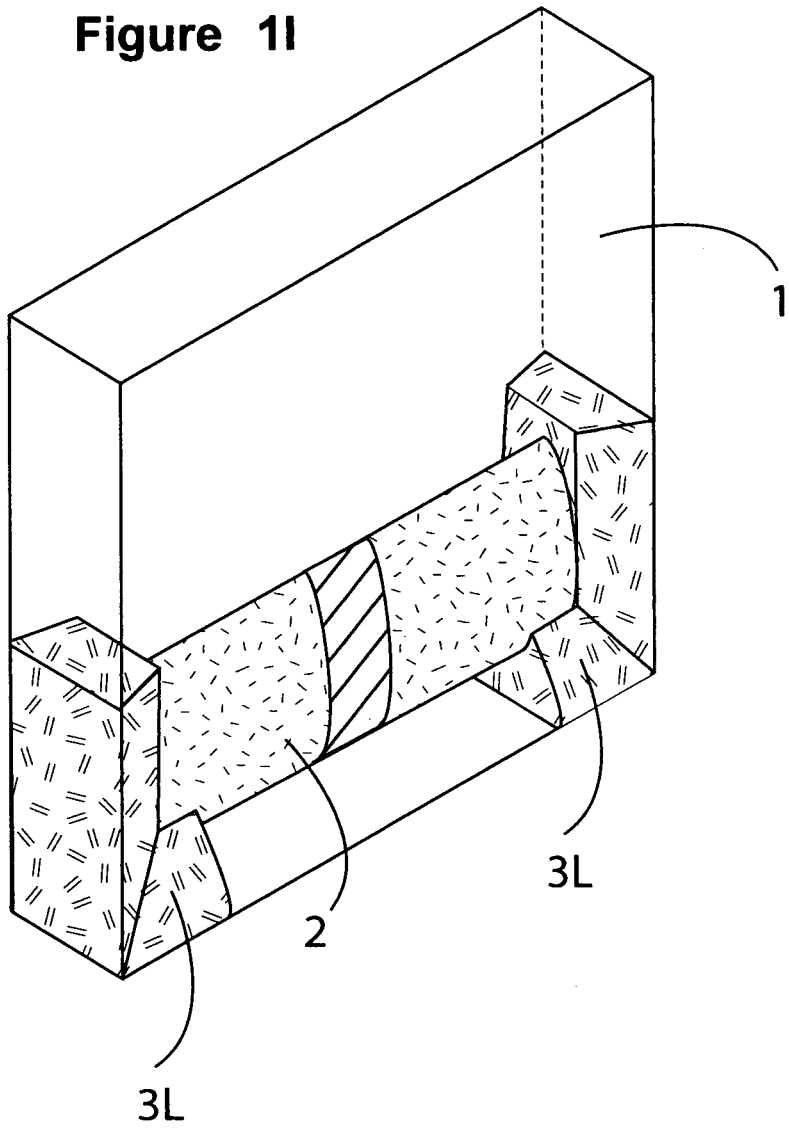
FIG. 1I is an isometric view of a cushion of a typical embodiment of the present invention with two 'L' shaped end stabilizers under the lumbar support.

FIG. 1I is an isometric view of a cushion of a typical embodiment of the present invention with two 'L' shaped end stabilizers 3L under the lumbar support 2. The 'L' shaped stabilizers 3L can be tapered inward slightly, to prevent from showing through the upholstery. The 'L' shaped stabilizers 3L as shown, provide full height, position, and alignment stabilization for the lumbar support 2, and do so with minimum bulk to displace the loose fill material 1. The outer sides or faces of the stabilizers 3L can be wrapped in Dacron or treated with another method to minimize the likelihood that they might show through the upholstery. Additionally, the edges can be rounded over slightly to soften the pressure that could result in the stabilizer showing through the upholstery. These techniques, and other techniques known in the industry for softening edges on foam can be used for any of the faces on any of the stabilizers and/or lumbar supports on any of the embodiments described in this patent, to minimize any show through on upholstery.

Figure 2A:
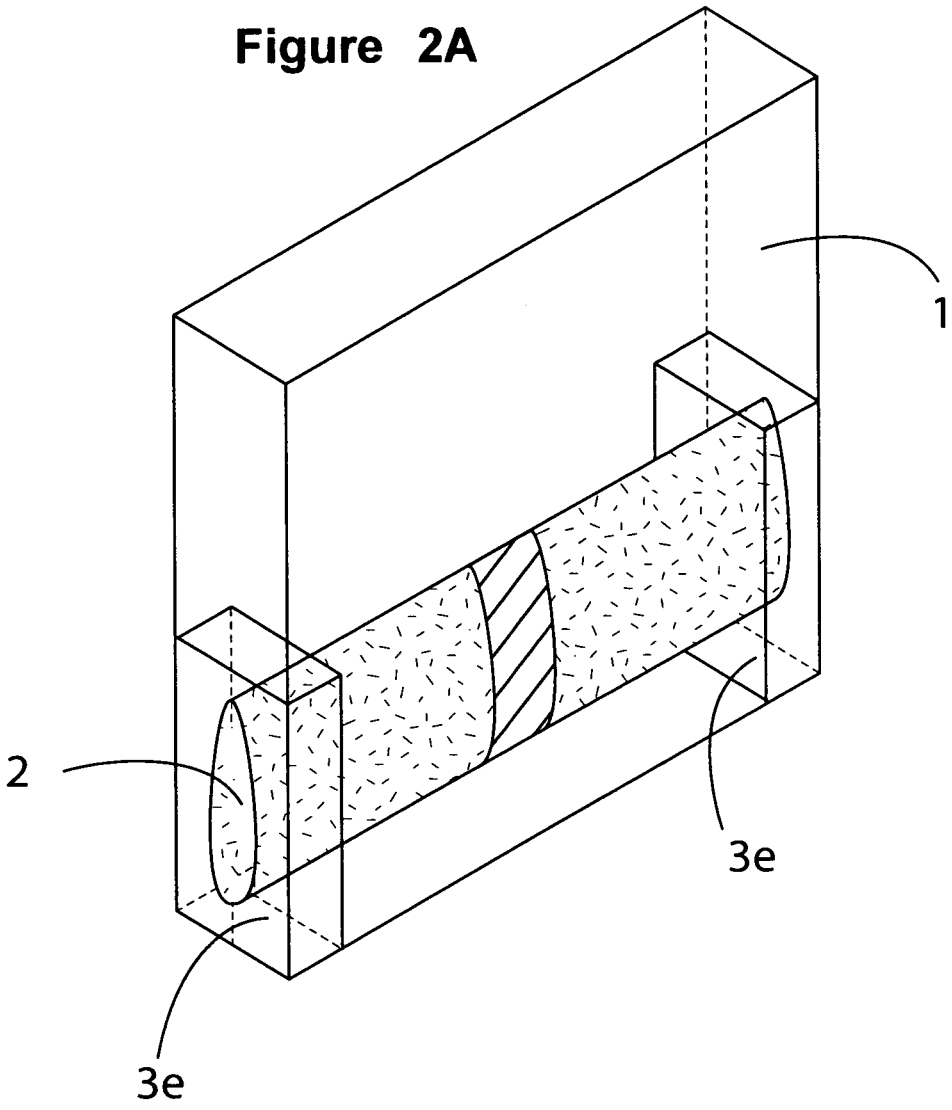
FIG. 2A is an isometric view of a cushion of a typical embodiment of the present invention, with two short side stabilizers on the ends of the lumbar support.

FIG. 2A is an isometric view of a cushion of a typical embodiment of the present invention, with two short side stabilizers 3*e* on the ends of the lumbar support 2. In this embodiment, the short side stabilizers 3*e* can be cut from polyurethane foam, with the lumbar support 2 inserted as shown, with an adhesive to secure the lumbar support 2 to the side stabilizers 3*e*. To minimize any hard edges showing through upholstery, the outside of the side stabilizers can be covered with Dacron or another wrap, and/or the edges can be softened by buffing or otherwise rounding over the edges. Also, the lumbar support 2 (except for the soft center) could be firm, but the stabilizers 3*e* can be medium or soft foam. Also, the lumbar support 2 can be cut an inch or so shorter than the cushion width, so that it can be recessed about ½" from the outside of the stabilizer 3*e*, so that the firm lumbar support outline does not show through the upholstery fabric. Also, these can be tapered as shown in FIG. 1I (as can other side stabilizing components) to reduce the likelihood of showing through the upholstery.

Figure 2B:
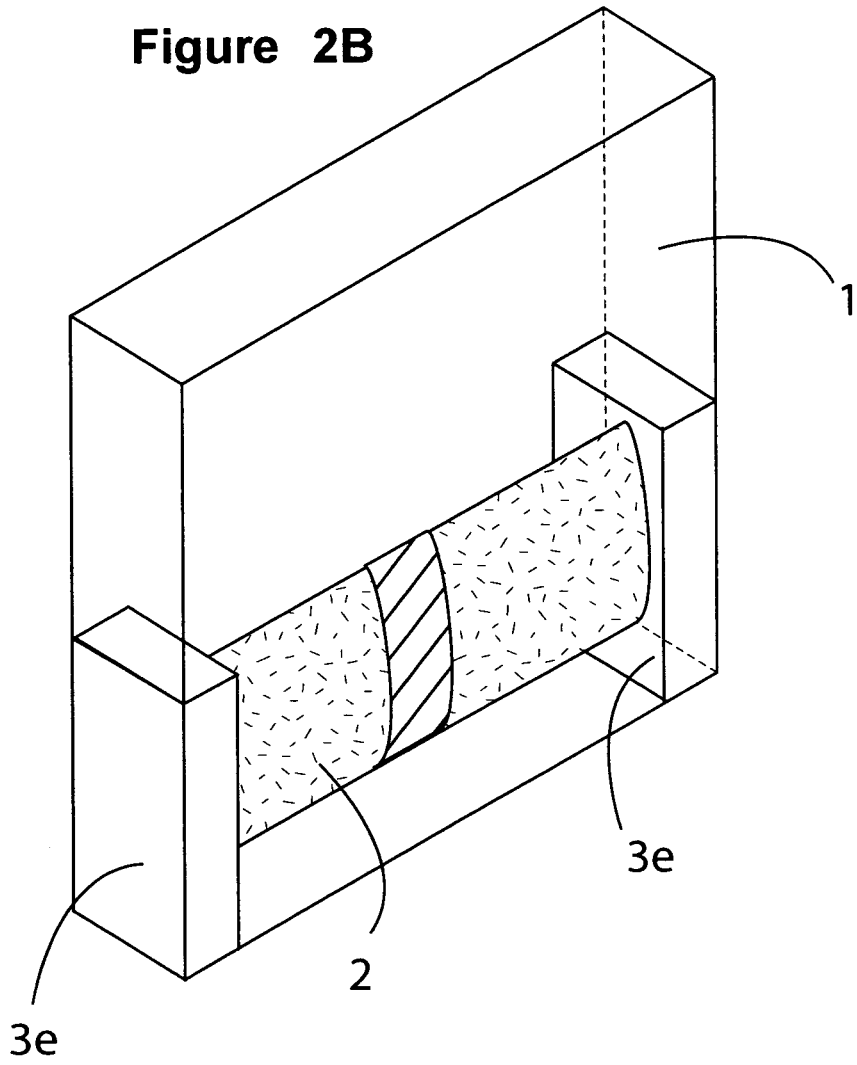
FIG. 2B is an isometric view of a cushion of a typical embodiment of the present invention similar to 2A, but where the lumbar support does not go through the end supports.

FIG. 2B is an isometric view of a cushion of a typical embodiment of the present invention similar to 2A, but where the lumbar support 2 does not go through the end stabilizers 3*e*. This is done to minimize the likelihood that the lumbar support 2 would show through the upholstery fabric.

Figure 2C:
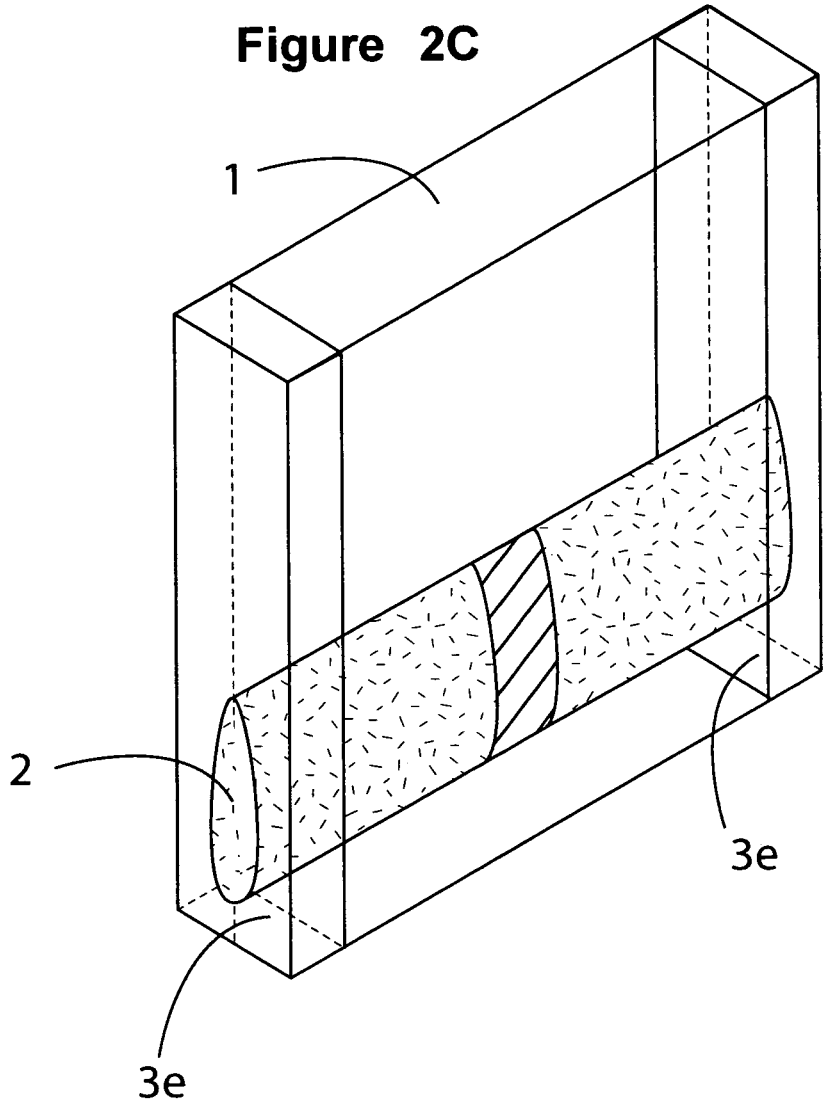
FIG. 2C is an isometric view of a cushion of a typical embodiment of the present invention, with two tall side stabilizers on the ends of the lumbar support.

FIG. 2C is an isometric view of a cushion of a typical embodiment of the present invention, with two tall side stabilizers 3*e* on the ends of the lumbar support 2. This is similar to the embodiment in FIG. 2A, but the side stabilizers 3*e* go all the way to the top of the cushion.

Figure 2D:
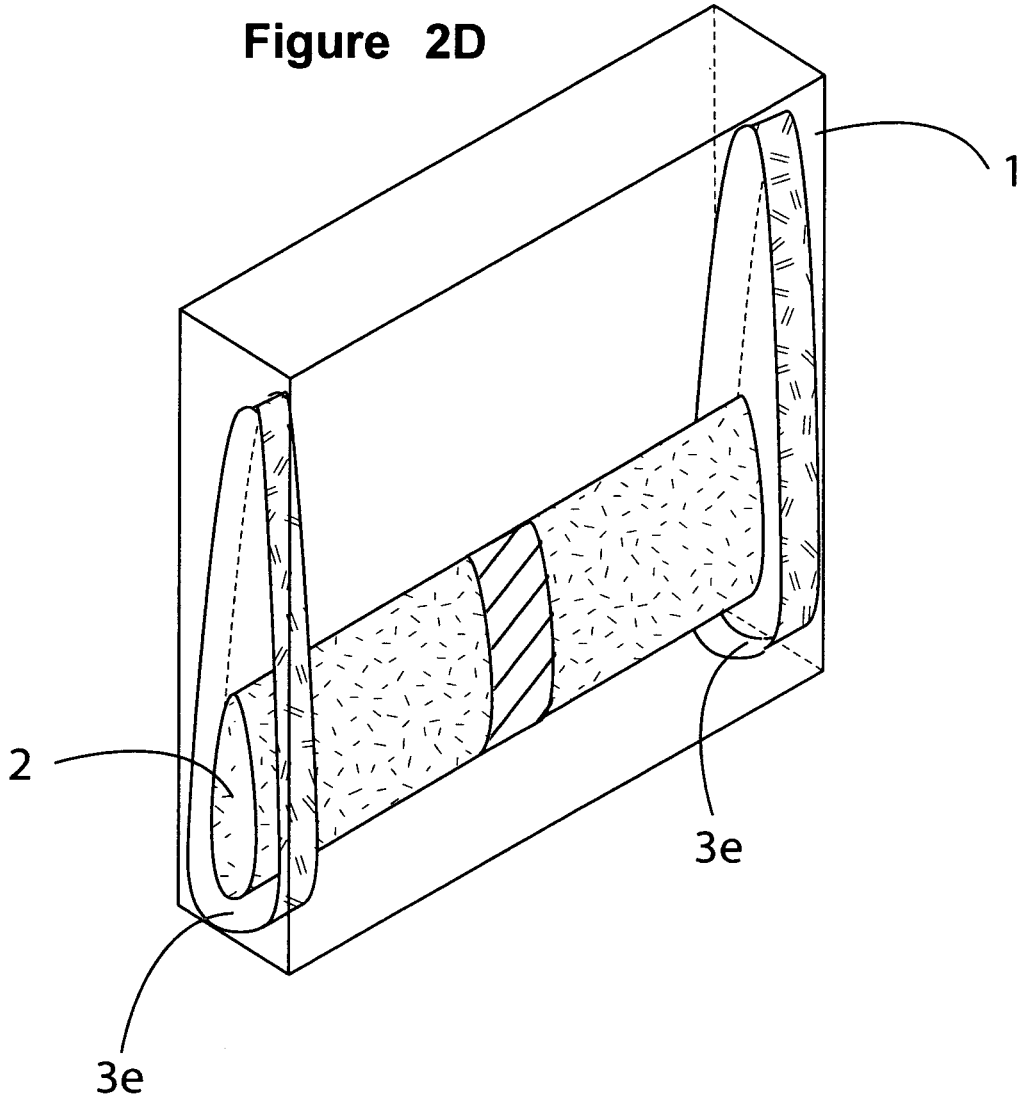
FIG. 2D is an isometric view of a cushion of a typical embodiment of the present invention, with two contoured side stabilizers on the ends of the lumbar support.

FIG. 2D is an isometric view of a cushion of a typical embodiment of the present invention, with two contoured side stabilizers 3*e* on the ends of the lumbar support 2. The purpose of this is to minimize the likelihood of the side stabilizers 3*e* from showing through the upholstery fabric on the cushion.

Figure 2E:
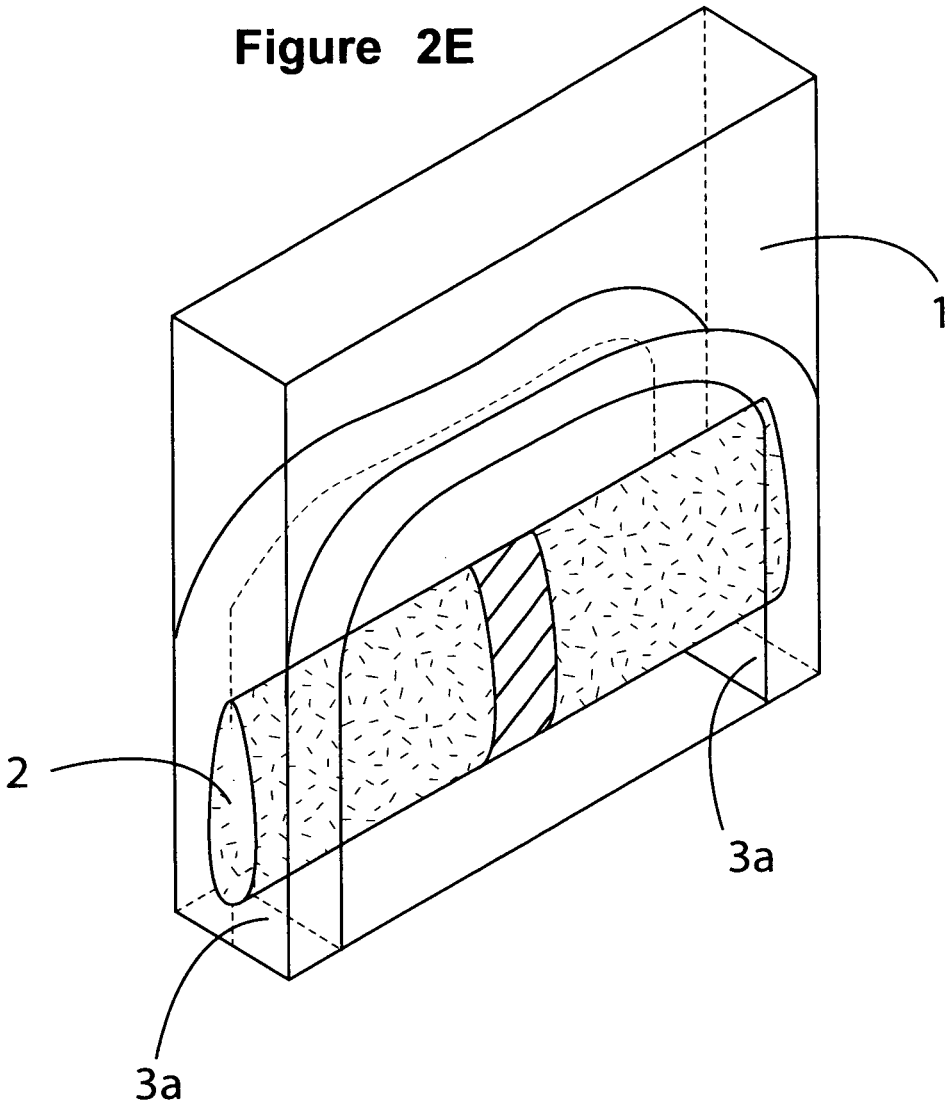
FIG. 2E is an isometric view of a cushion of a typical embodiment of the present invention, with an arch shaped stabilizer with the generally vertical portions attached to the ends of the lumbar support.

FIG. 2E is an isometric view of a cushion of a typical embodiment of the present invention, with an arch shaped stabilizer 3*a* with the generally vertical portions attached to the ends of the lumbar support 2. As shown, the arch shaped stabilizer 3*a* is shown a bit thinner toward the middle above the lumbar support 2.

Figure 2F:
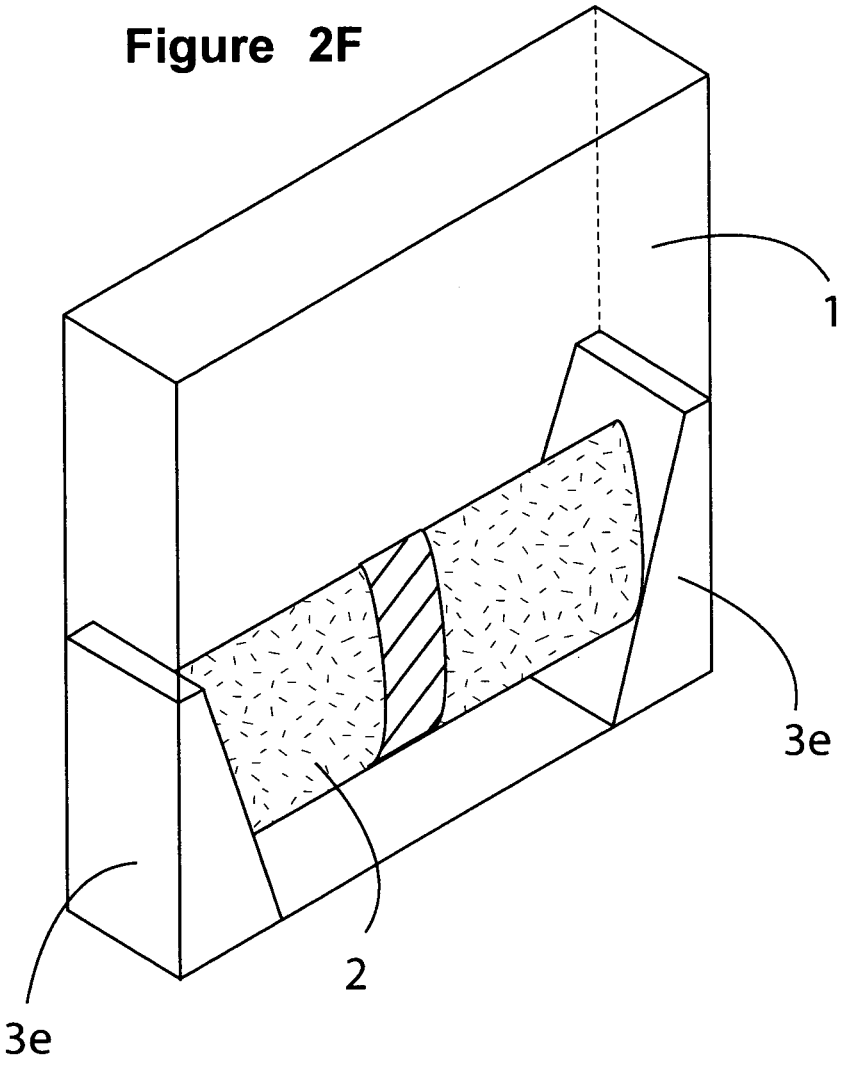
FIG. 2F is an isometric view of a cushion of a typical embodiment of the present invention, with two wedge shaped stabilizers on the ends of the lumbar support.

FIG. 2F is an isometric view of a cushion of a typical embodiment of the present invention, with two wedge shaped stabilizers 3*e* on the ends of the lumbar support 2.

Figure 2G:
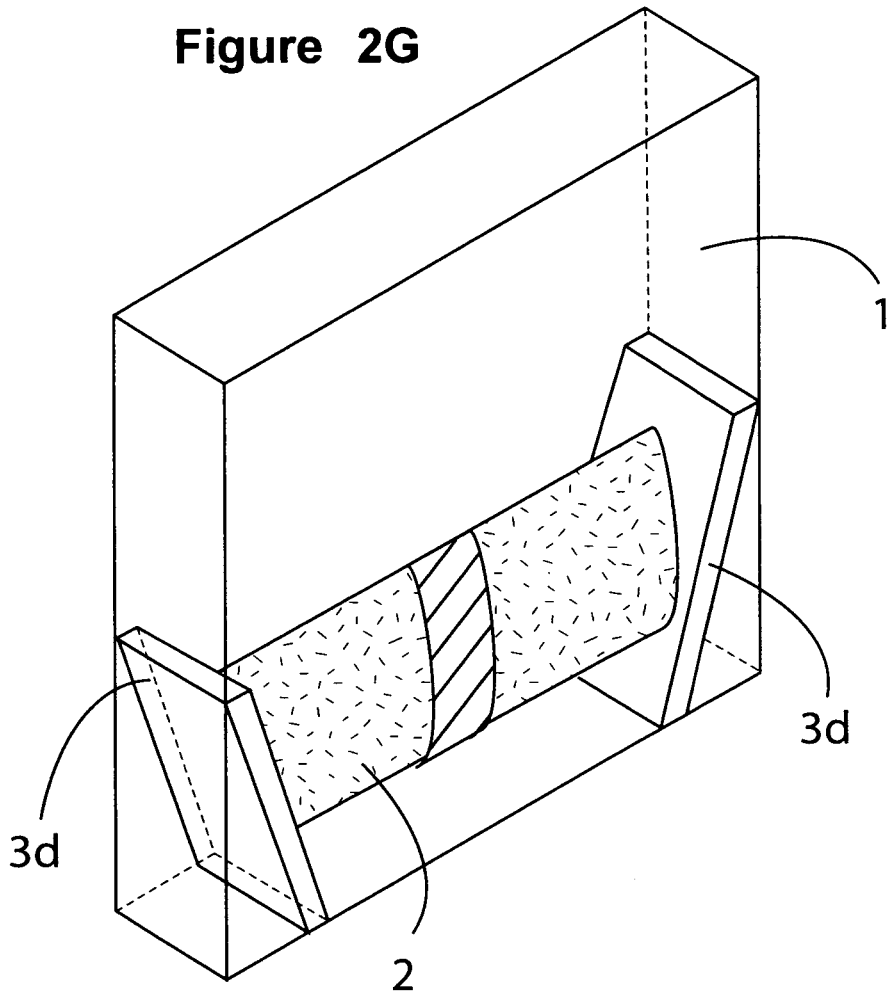
FIG. 2G is an isometric view of a cushion of a typical embodiment of the present invention, with two diagonal side stabilizers on the ends of the lumbar support.

FIG. 2G is an isometric view of a cushion of a typical embodiment of the present invention, with two diagonal side stabilizers 3*d* on the ends of the lumbar support 2.

Figure 2H:
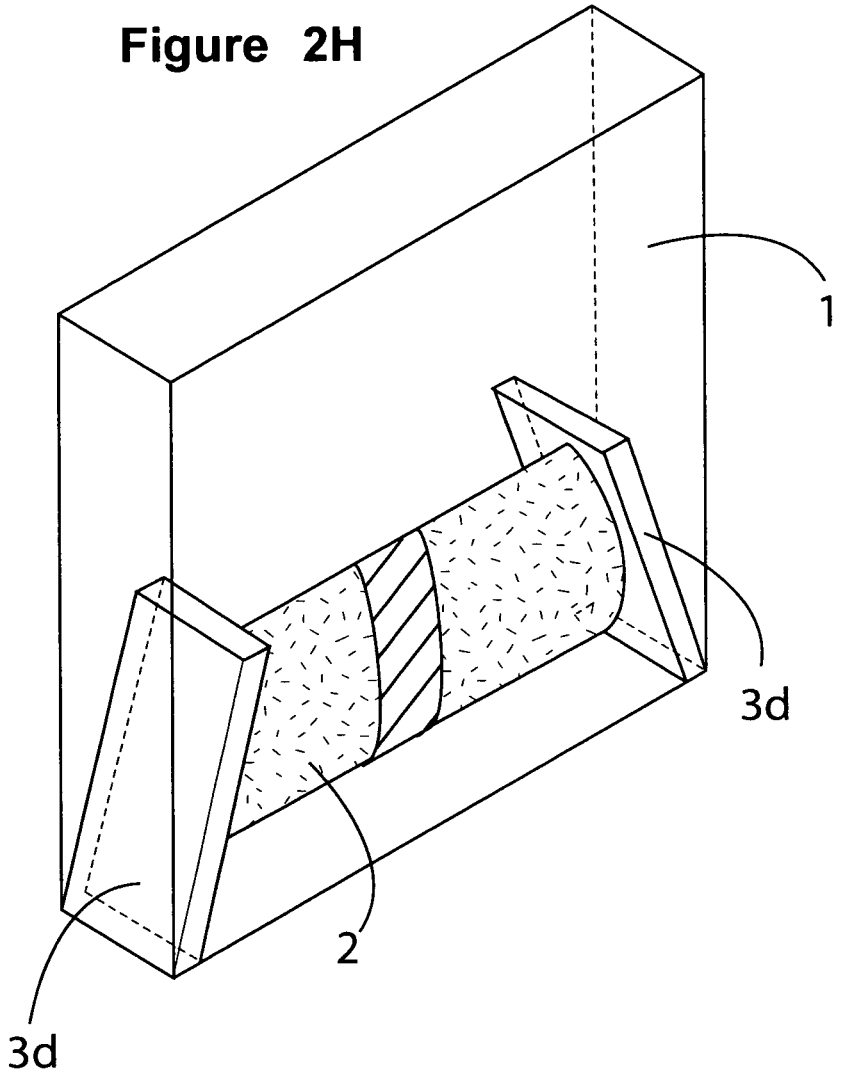
FIG. 2H is an isometric view of a cushion of a typical embodiment of the present invention, with two diagonal side stabilizers on the ends of the lumbar support similar to FIG. 2G, but with the diagonal side stabilizers tilting toward the center.

FIG. 2H is an isometric view of a cushion of a typical embodiment of the present invention, with two diagonal side stabilizers 3*d* on the ends of the lumbar support 2 similar to the embodiment in FIG. 2G, but with the diagonal side stabilizers 3*d* tilting toward the center.

Figure 2I:
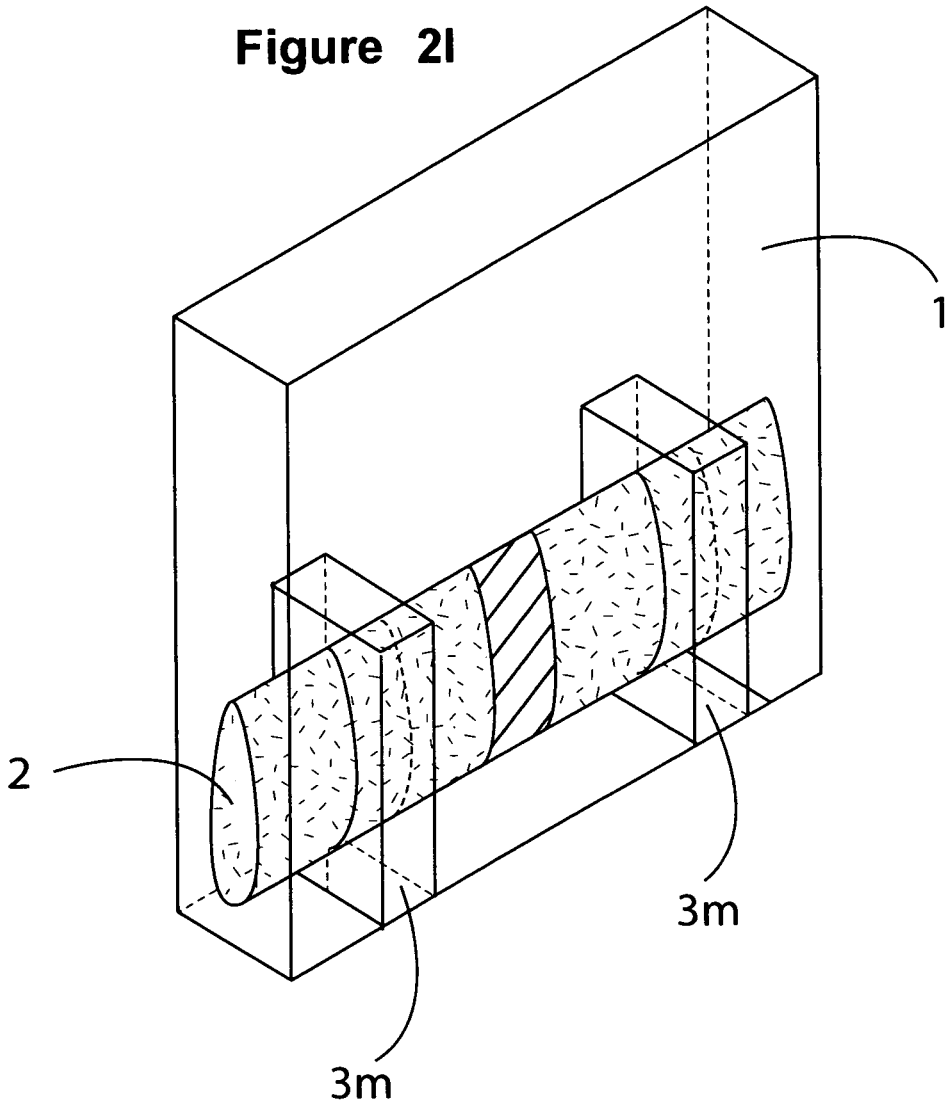
FIG. 2I is an isometric view of a cushion of a typical embodiment of the present invention, with two stabilizers positioned away from the ends of the lumbar support.

FIG. 2I is an isometric view of a cushion of a typical embodiment of the present invention, with two stabilizers 3*m* positioned away from the ends of the lumbar support 2.

Figure 3A:
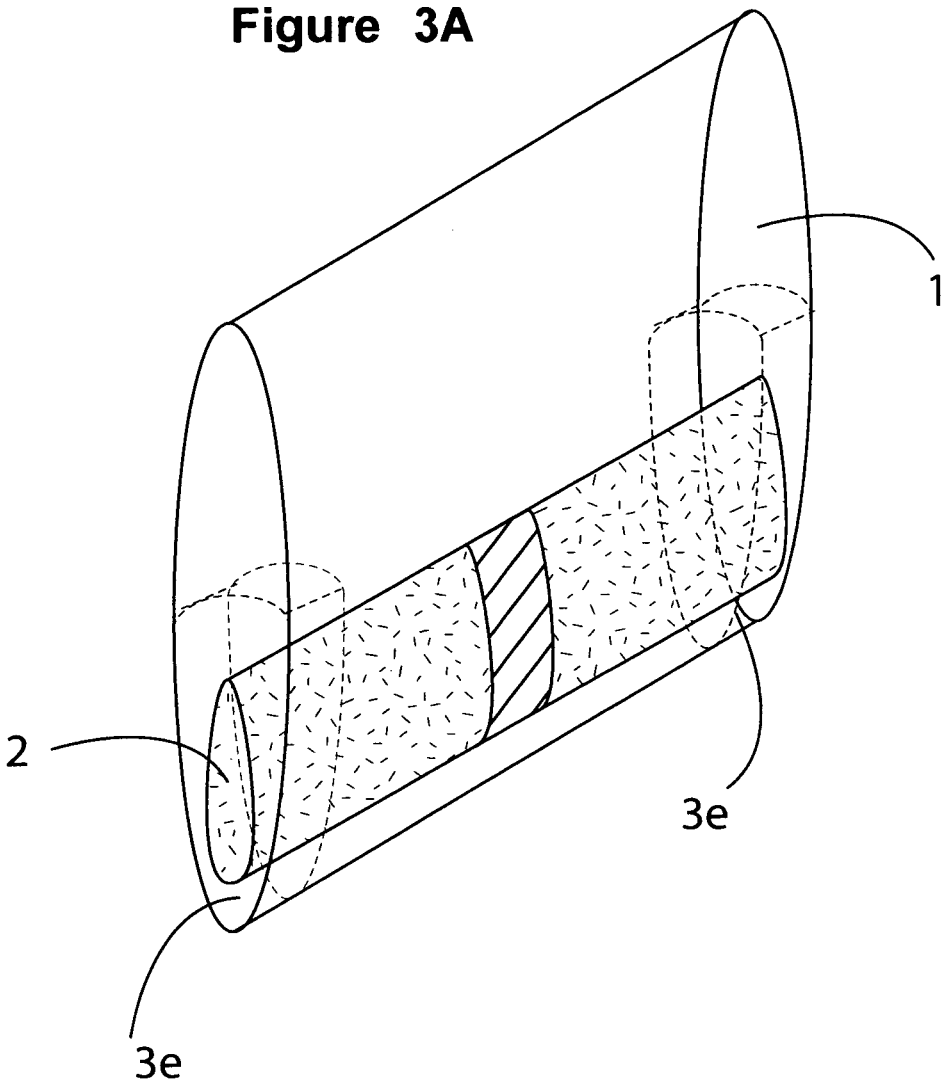
FIG. 3A is an isometric view of a knife edged top and bottom cushion of a typical embodiment of the present invention with end stabilizers for the lumbar support.

FIG. 3A is an isometric view of a knife edged top and bottom cushion of a typical embodiment of the present invention with end stabilizers 3*e* for the lumbar support 2.

Figure 3B:
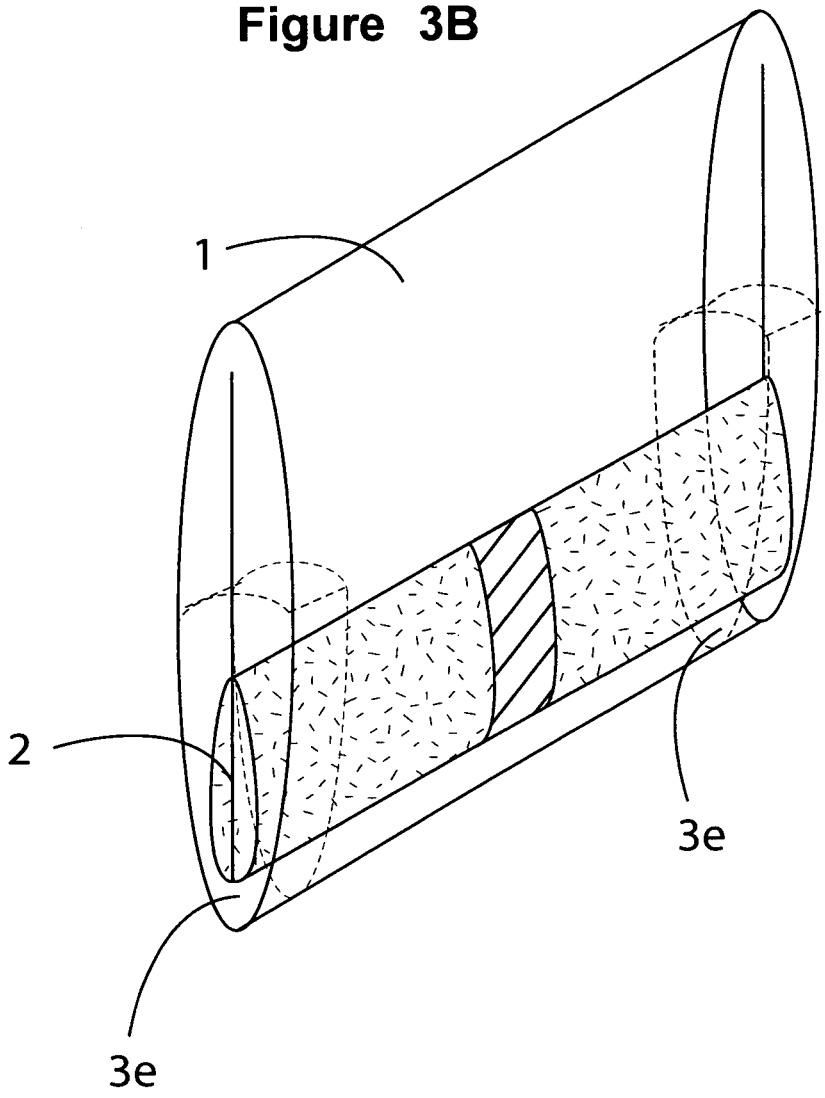
FIG. 3B is an isometric view of a cushion with knife edged sides as well as top and bottom of a typical embodiment of the present invention with end stabilizers for the lumbar support.

FIG. 3B is an isometric view of a cushion with knife edged sides as well as top and bottom of a typical embodiment of the present invention with end stabilizers 3*e* for the lumbar support 2.

Figure 3C:
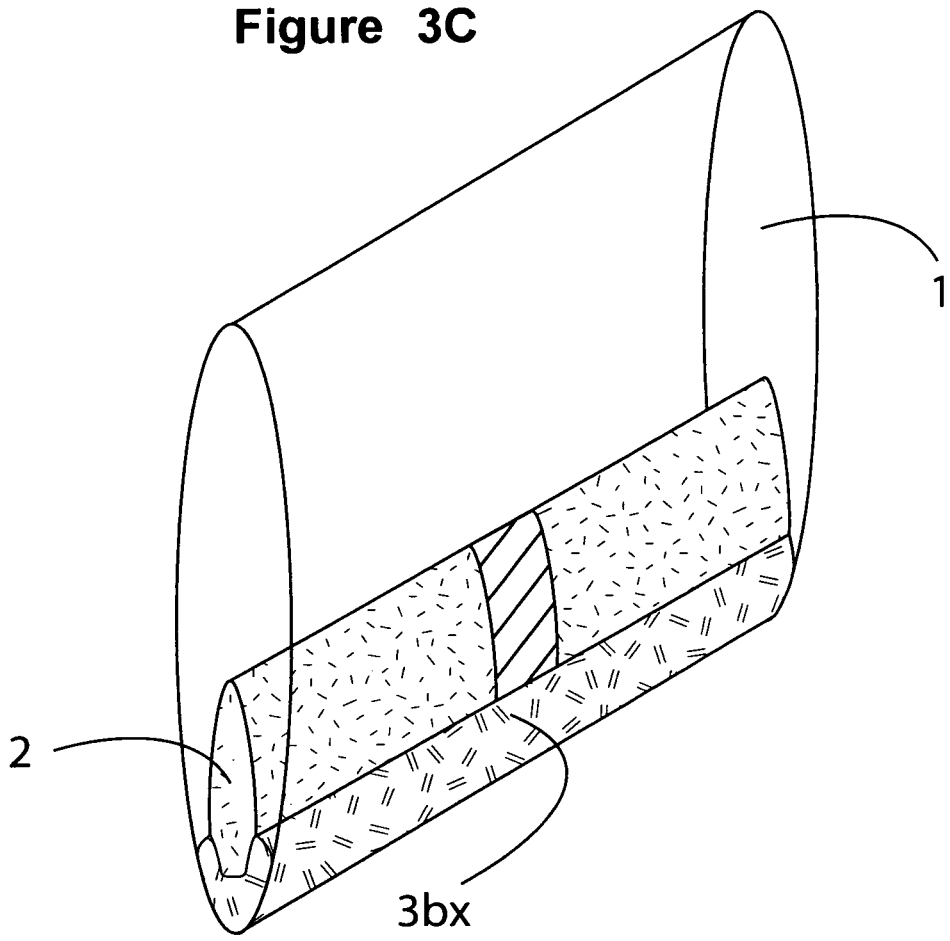
FIG. 3C is an isometric view of a knife edged top and bottom cushion of a typical embodiment of the present invention with a convex base stabilizer for the lumbar support.

FIG. 3C is an isometric view of a knife edged top and bottom cushion of a typical embodiment of the present invention with a convex base 3*bx* stabilizer for the lumbar support 2.

Figure 4:
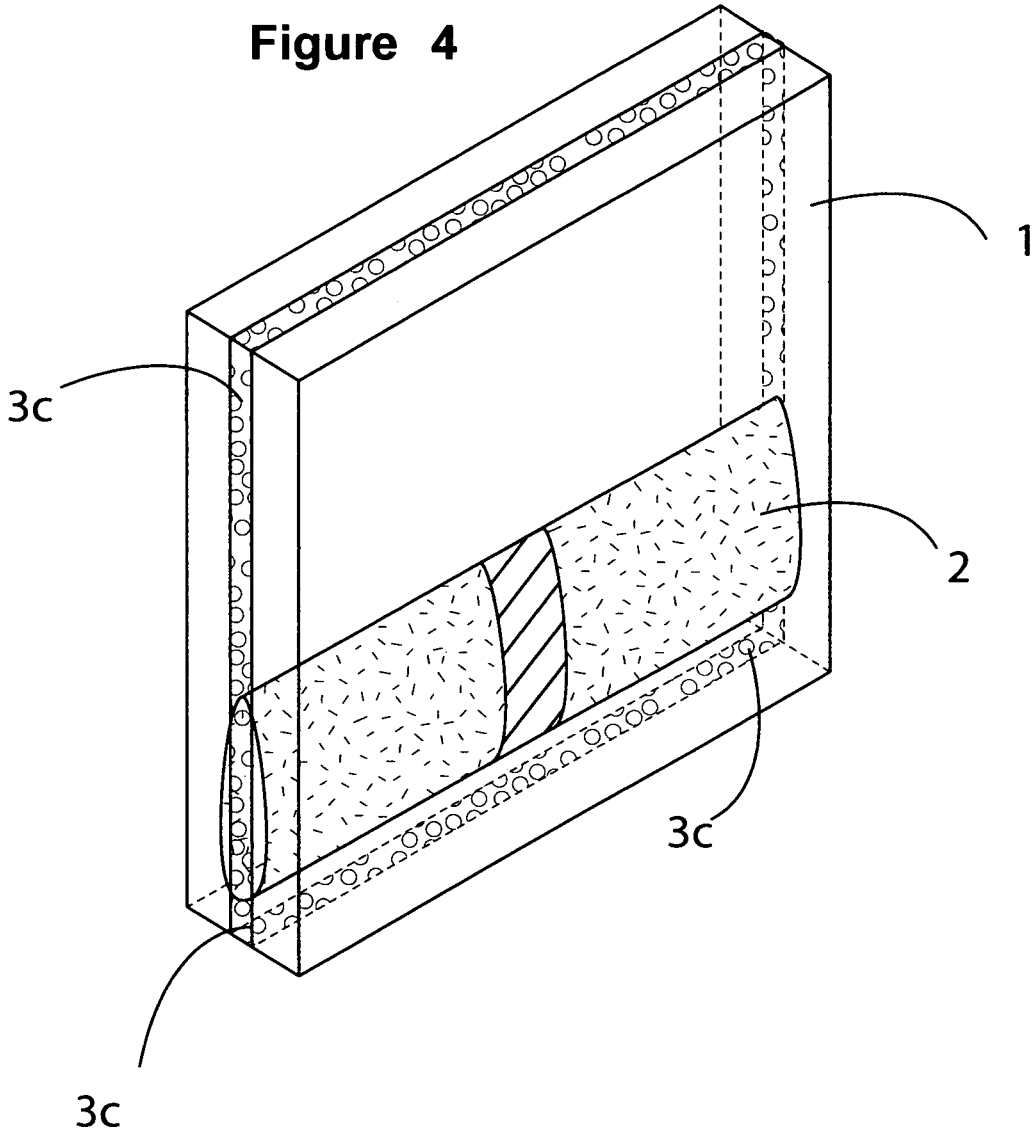
FIG. 4 is an isometric view of a cushion of a typical embodiment of the present invention, with a center foam core as a stabilizer for the lumbar support.

FIG. 4 is an isometric view of a cushion of a typical embodiment of the present invention, with a center foam core 3*c* as a stabilizer for the lumbar support 2.

Figure 5:
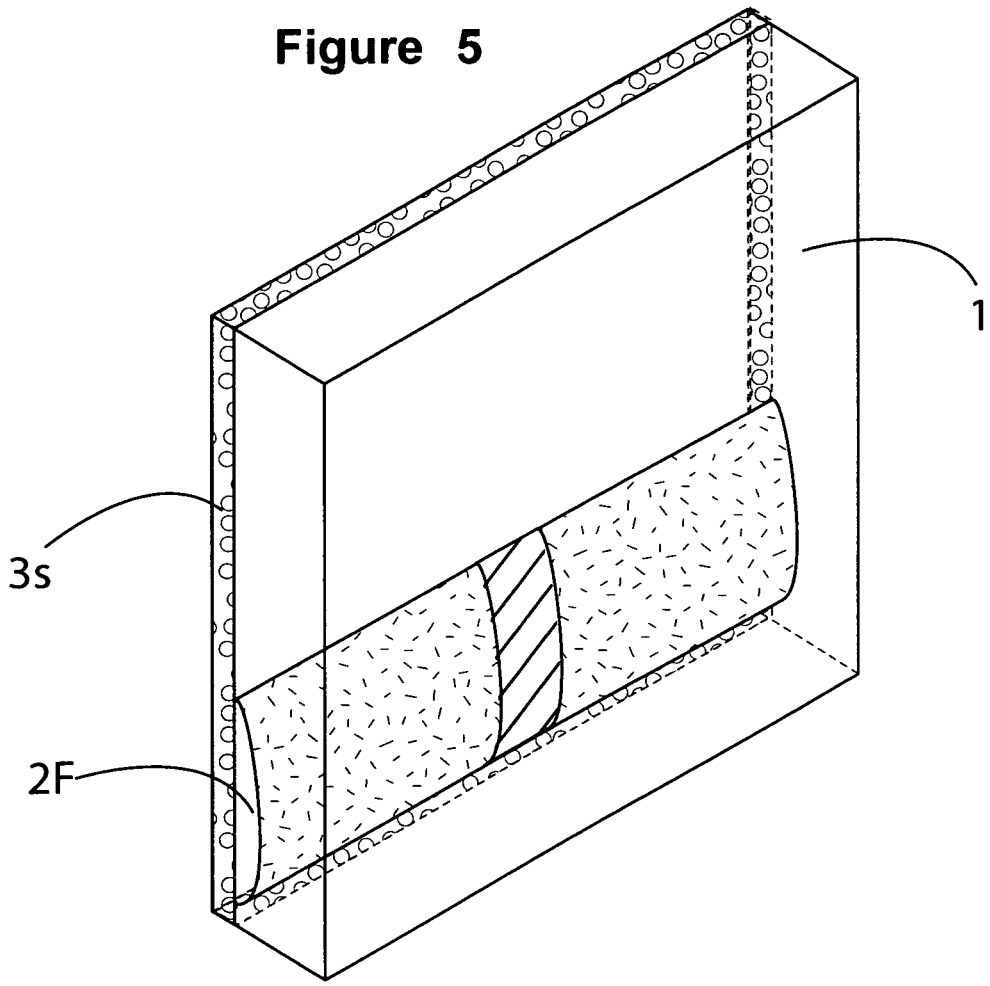
FIG. 5 is an isometric view of a non-reversible cushion of a typical embodiment of the present invention, with the lumbar support attached to a sheet of foam opposite the face of the cushion.

FIG. 5 is an isometric view of a non-reversible cushion of a typical embodiment of the present invention, with the lumbar support 2*f* attached to a sheet of foam 3*s* opposite the face of the cushion.

Figure 6A:
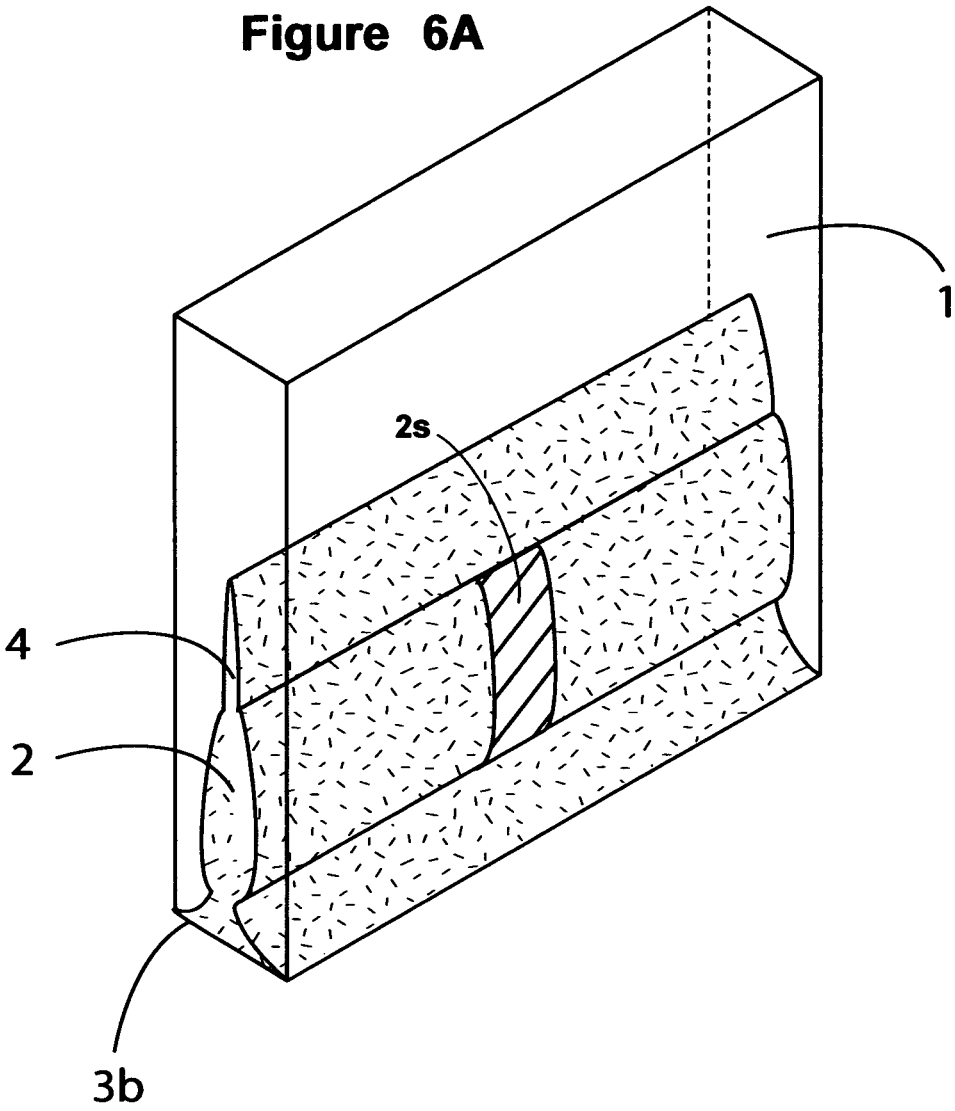
FIG. 6A is an isometric view of a cushion of a typical embodiment with a fin 4 on top of the lumbar support to provide an additional level of support to keep the lumbar support in correct alignment.

FIG. 6A is an isometric view of a cushion of a typical embodiment with a fin 2*f* on top of the lumbar support to provide an additional level of support to keep the lumbar support in correct alignment.

Figure 6B:
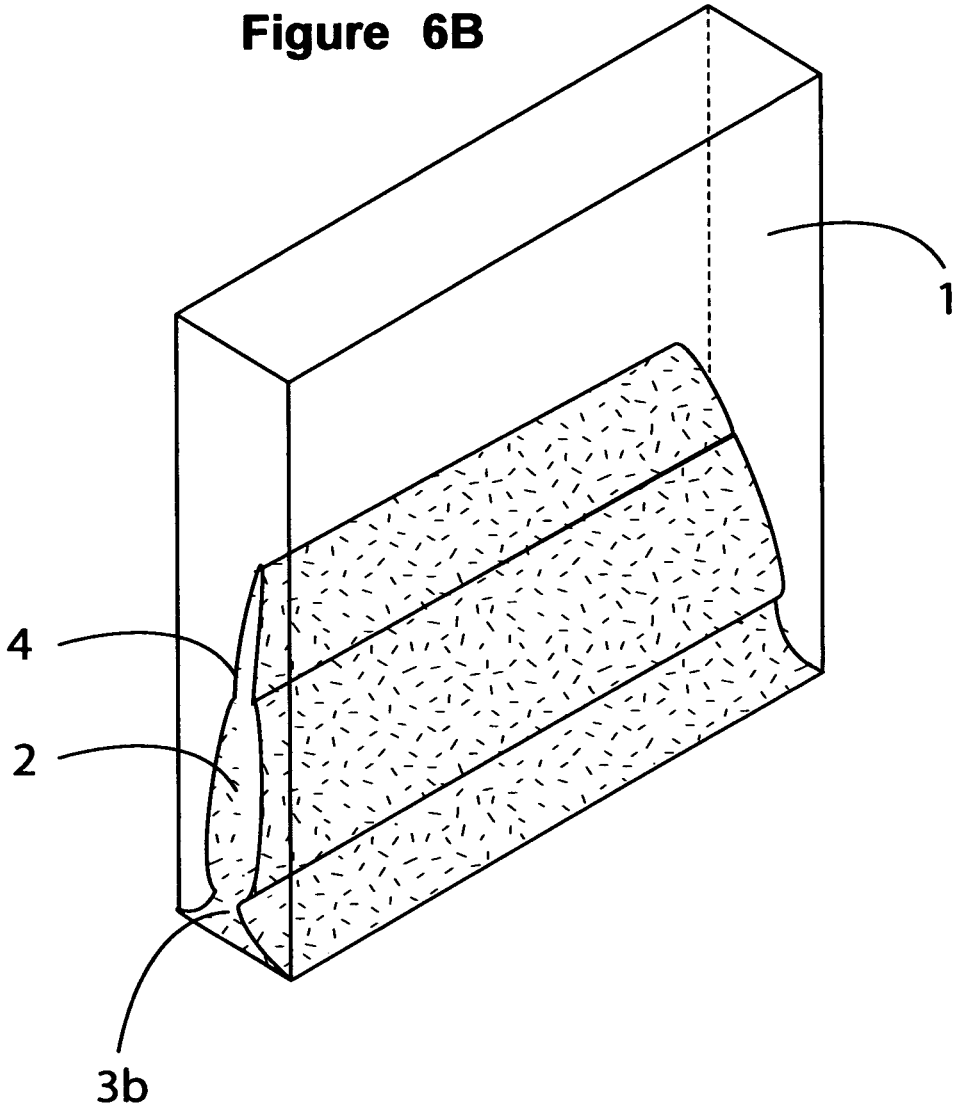
FIG. 6B is an isometric view of a cushion similar to that shown in FIG. 6A, but with a curve or taper to keep the sides of the lumbar support and stabilizer away from the sides of the cushion.

FIG. 6B is an isometric view of a cushion similar to that shown in FIG. 6A, but with a curve or taper to keep the sides of the lumbar support and stabilizer away from the sides of the cushion.

Figure 6C:
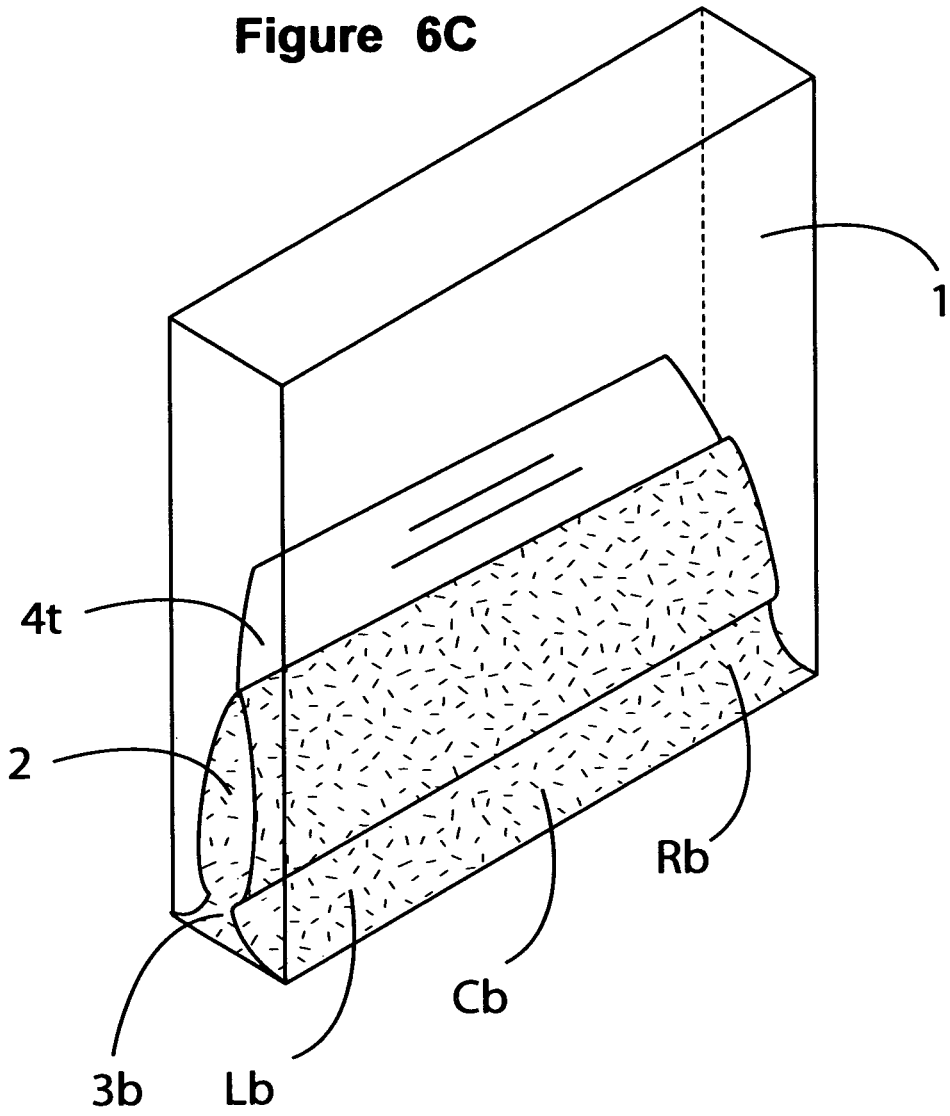
FIG. 6C is an isometric view of a cushion of a typical embodiment with a fin 4*t* on top of the lumbar support to provide an additional level of support similar to those shown in FIGS. 6A and 6B, but with the fin made of another material such as a plastic that can be thinner while being strong.

FIG. 6C is an isometric view of a cushion of a typical embodiment with a fin 4*t* on top of the lumbar support to provide an additional level of support similar to those shown in FIGS. 6A and 6B, but with the fin made of another material such as a plastic that can be thinner while being strong.

Figure 7:
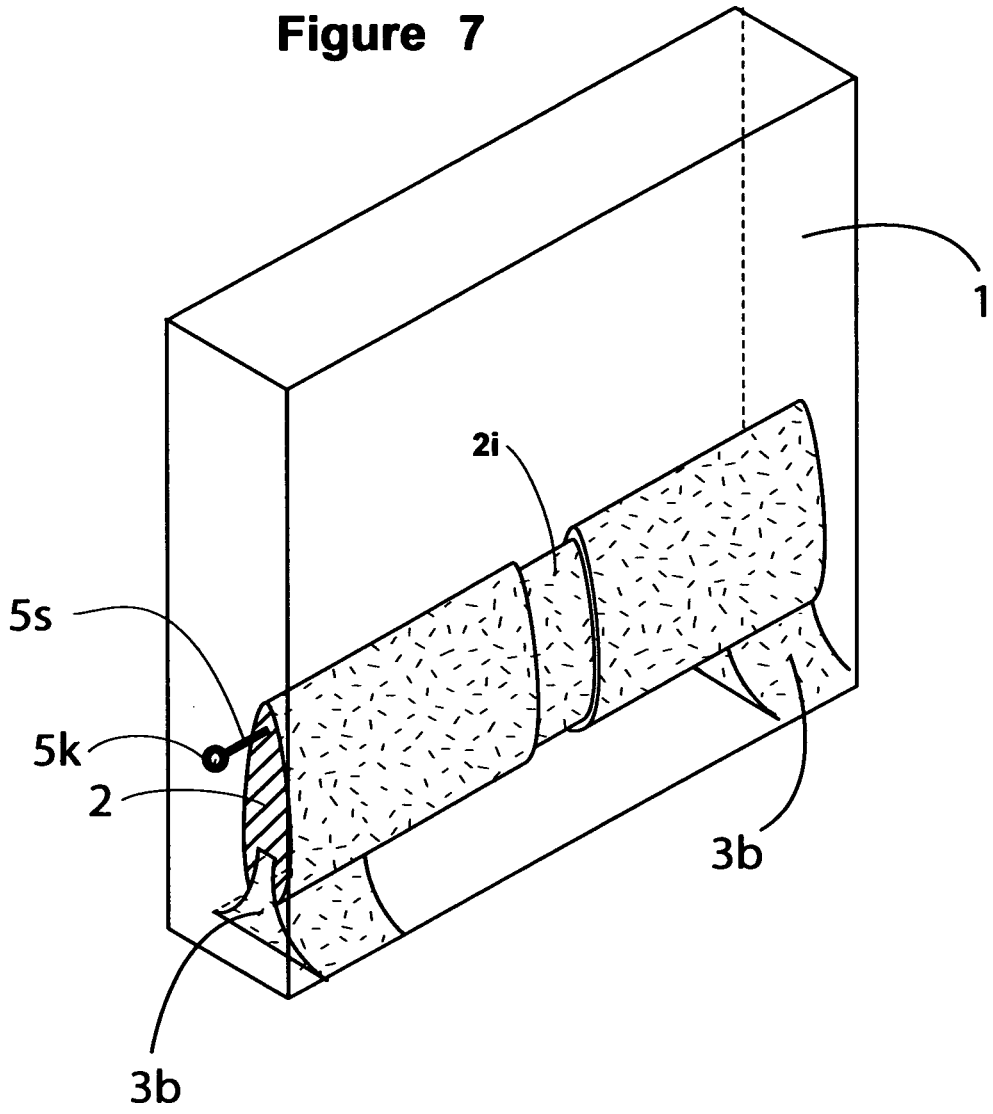
FIG. 7 is an isometric view of a cushion of a typical embodiment with a mechanical fastener 5*s* and 5*k* to help hold the lumbar support 2 in the proper alignment.

FIG. 7 is an isometric view of a cushion of a typical embodiment with a mechanical fastener 5*s* and 5*k* to help hold the lumbar support 2 in the proper alignment.

OPERATION OF INVENTION

Loose fill cushions can be very soft and comfortable, but they tend to be not supportive for the spine, especially for the lumbar region. With the present invention, a loose fill cushion can be supportive with a firmer lumbar support that is suspended within the loose fill material. The loose fill material alone may not be sufficient to support the lumbar support in the proper position, and alignment, so this invention provides a way to stabilize the suspended lumbar support within the loose fill material, thus maintaining the proper height, position, and alignment—even as the loose fill material may have a tendency to settle.

The stabilizers are made of a resilient material such as a high density polyurethane foam that will bounce back to its original shape over years of use. Loose fill materials are typically put into an inner cover, such as cambric or ticking, or they are simply put inside a finished upholstery fabric cover. The lumbar supports with stabilizers work with either.

To make a cushion with the lumbar support and stabilizer, normally the lumbar support and stabilizer will be placed in the cover in the correct position, and the loose fill material is used to fill the cover the rest of the way. Then the cover is zipped or otherwise closed. The loose fill material is to be put around the lumbar support and stabilizers, to fill all the voids. Once this is done, and the cover closed, the lumbar support and stabilizers will be in place and properly positioned and aligned, and should not noticeable. There should be no unsightly protrusions. A person looking at the cushion will think it looks like an ordinary loose fill cushion, but when they sit on it, it helps support and align their back and posture. Most of the embodiments shown are reversible, but this invention is also suitable for single facing cushions. The reversible cushions can have an adjustable lumbar support, such that the lumbar support can be positioned a bit more toward one body contacting surface or the other. Thus, in one position, the user feels more lumbar support, but it is reversed, there is less lumbar support.

The size and shape of the lumbar support would be dependent upon the firmness of the lumbar support, the type and firmness of loose fill cushioning material, and personal preferences. A softer lumbar support, could be thicker than a firmer lumbar support. In a presently preferred embodiment, the lumbar support has an IFD (Indentation Force Deflection) of about 40 to 50 pounds. The size of the lumbar support for a 5" thick cushion would be about 3" thick at the apex of the lumbar support, the lumbar support itself would be about 12" high, and it would be approximately as wide as the cushion, or at least wide enough to provide good lumbar support for the user. The lumbar support could be adjusted for different thickness cushions, or for different firmnesses. The objective is to provide both comfort and proper lumbar support. The lumbar support could be in the shape of a generally elliptical cylinder, or somewhat of a teardrop shape cylinder—that is like an elliptical cylinder, but more bottom heavy. The wider the lumbar support, the more it would distribute the load of the person sitting against it against the loose fill cushioning material behind it. The preceding refers to reversible cushions, and for non-reversible cushions, a generally semi elliptical or semi-teardrop shaped semi-cylinder would preferably be used, as shown in FIG. 5. The lumbar support shown in many of the drawings has a softer center 2*s* that might be made of flexible polyurethane foam with an IFD of closer to 20 pounds. In a preferred embodiment, this is about 2½" wide. As indicated elsewhere, it is not critical that there be a softer center, and thus the entire lumbar support can be of a uniform thickness and material. Another shown is an indentation 2*i* as shown in FIG. 1C. Other ways of doing this are known or will be known, and can be applied to this invention. The shape and position of lumbar curves on humans is well known in the industry related to ergonomic furniture. The objective is to help the person sitting on the chair or sofa maintain a relatively natural lordotic curve in their lower back. When a person sits against the loose fill cushion with the internal lumbar support, the softer cushioning material would compress to a greater extent than would the firmer lumbar support, thus a person leaning against the cushion would experience varying degrees of support behind his or her back, and the most support would be behind the lumbar region. Because the loose fill material is "loose", it is a dynamic cushioning material—that is it changes, and the loose fill material can move around a bit. Though the inventor does not wish to be bound by this, it is believed that the loose fill material will move and rearrange itself after each sitting, filling in voids as it settles and rebounds after a person sits in it. This should help maintain relative uniformity in the cushion from an appearance perspective.

The position of the lumbar support would be dependent upon the distance a person sitting on the seat cushion would likely sink into the seat cushion, so that the lumbar support could be approximately aligned to the lumbar curve of the person. The lumbar support stabilizer needs to raise the lumbar support a sufficient height to align with the lumbar curve of a person. This lumbar support stabilizer would normally rest on the bottom of the cushion, supported by the upholstery and/or the seat cushion or other structure under cushion. The lumbar support stabilizer(s) in a preferred embodiment is about as thick as the cushion, though it can be somewhat smaller, and can also be wrapped in Dacron of another product to prevent it from being visible, and possibly also to provide some additional support. Though under the lumbar support, it would preferably have either a concave curve as shown for example in FIG. 1A, have an open space between base stabilizers as shown for example in FIG. 1B, or be of a soft material such as shown for example in FIG. 1F. The purpose of the configuration as described above, is to avoid creating pressure on the sacral curve of the person sitting against it, as this might have a tendency to flatten the user's lumbar curve, instead of making it convenient to have a natural lordotic curve.

CONCLUSIONS RAMIFICATIONS AND SCOPE OF THE INVENTION

Thus the reader will see that this invention can be used for many types of chairs, sofas and other cushions. This can be made with many materials, including "loose" fillings and with either foam or other resilient materials for the lumbar support and/or lumbar support stabilizer. And though some materials such as polyurethane foam are used, there may be other highly resilient elastic materials developed and suitable for the furniture industry that can be substituted. It is not even necessary that the lumbar support and stabilizer be made of solid foam, but could be made of a resilient material that could be hollow, yet maintaining similar support. And of course, the shape, size, and level of support can be modified based on preference or economic considerations. Also, though most cushions shown are rectangular, that does not prevent the principles from being applied to cushions that have a curved top or sides, and there is no requirement that the front be generally flat as shown.

Further, most features of various embodiments are interchangeable between other embodiments. For example, the fin 4 shown in FIG. 6B could be used with the lumbar support and stabilizer shown in FIG. 1F. Thus the scope of the invention should be determined by the appended claims and their legal equivalents, rather than by the examples given.

I claim:

1. A backrest cushion comprising:

(a) a generally rectangular loose fill cushion body, having a top and a bottom, a front and a back, and a left side and a right side;

(b) a generally firmer resilient foam lumbar support member, said firmer resilient lumbar support member having a back surface and a generally convex front surface; and (c) at least one lumbar support member stabilizer extending from the bottom of said loose fill cushion body, wherein said lumbar support member and lumbar support member stabilizer are within said loose fill cushion body, with loose fill material surrounding and generally contacting the front and back surfaces of said lumbar support member, wherein said lumbar support member stabilizer is attached to said lumbar support member, wherein said lumbar support member stabilizer maintains said lumbar support member generally suspended within the loose fill cushion body with a height and alignment suitable for providing lumbar support for a person leaning against the backrest cushion, such that the person's lumbar is in a relatively natural lordotic curve.

2. The lumbar support member stabilizer of claim 1, further having side alignment stabilizers secured to the lumbar support member above the lumbar support member stabilizer.

3. The lumbar support member of claim 1, further having a fin extending above the lumbar support member for alignment stability.

4. The lumbar support member stabilizer of claim 1, wherein the lumbar support member stabilizer extends substantially from the left side to the right side of the cushion body.

5. The lumbar support member stabilizer of claim 1, wherein the lumbar support member stabilizer is made of a relatively soft resilient material.

6. The lumbar support member stabilizer of claim 1, wherein one lumbar support member stabilizer is toward the left side and another lumbar support member stabilizer is toward the right side, and wherein further there is a void between the respective left and right side stabilizers.

7. A cushion comprising:

(a) a loose fill cushion body, having a top and a bottom, a front and a back, and a left side and a right side;

(b) a generally firmer resilient lumbar support member, said firmer resilient lumbar support member having a back surface and a generally convex front surface; and (c) at least one lumbar support member stabilizer extending from the bottom of said loose fill cushion body, wherein said lumbar support member and lumbar support member stabilizer are within said loose fill cushion body, with loose fill material surrounding and generally contacting the front and back surfaces of said lumbar support member, wherein said lumbar support member stabilizer is attached to said lumbar support member, wherein said lumbar support member stabilizer maintains said lumbar support member generally suspended within the loose fill cushion body with a height and alignment suitable for providing lumbar support for a person leaning against the backrest cushion, such that the person's lumbar is in a relatively natural lordotic curve.

8. The lumbar support member stabilizer of claim 7, further having side alignment stabilizers secured to the lumbar support member above the lumbar support member stabilizer.

9. The lumbar support member of claim 7, further having a fin extending above the lumbar support member for alignment stability.

10. The lumbar support member stabilizer of claim 7, wherein the lumbar support member stabilizer extends substantially from the left side to the right side of the cushion body.

11. The lumbar support member stabilizer of claim 7, wherein the lumbar support member stabilizer is made of a relatively soft resilient material.

12. The lumbar support member stabilizer of claim 7, wherein one lumbar support member stabilizer is toward the left side and another lumbar support member stabilizer is toward the right side, and wherein further there is a void between the respective left and right side stabilizers.

13. The lumbar support member stabilizer of claim 7 wherein an arch is formed over the lumbar support member for provision of alignment support.

14. A cushion comprising:

(a) a loose fill cushion body, having a top and a bottom, a front and a back, and a left side and a right side;

(b) a generally firmer resilient foam lumbar support member, said firmer resilient lumbar support member having a back surface and a generally convex front surface;

(c) a left lumbar support member stabilizer extending from the bottom of said loose fill cushion body and a right lumbar support member stabilizer extending from the bottom of said loose fill cushion body;

wherein said lumbar support member and lumbar support member stabilizer are within said loose fill cushion body, with loose fill material surrounding and generally contacting the front and back surfaces of said lumbar support member, wherein said lumbar support member stabilizers are attached to said lumbar support member, wherein said lumbar support member stabilizers maintains said lumbar support member generally suspended within the loose fill cushion body with a height and alignment suitable for providing lumbar support for a person leaning against the backrest cushion, such that the person's lumbar is in a relatively natural lordotic curve.

15. The lumbar support member stabilizers of claim 14, further having side alignment stabilizers secured to the lumbar support member above the lumbar support member stabilizers.

16. The lumbar support member of claim 14, further having a fin extending above the lumbar support member for alignment stability.

17. The lumbar support member stabilizers of claim 14, wherein the lumbar support member stabilizers extend substantially from the left side to the right side of the cushion body.

18. The lumbar support member stabilizers of claim 14, wherein the lumbar support member stabilizers are made of a relatively soft resilient material.

19. The lumbar support member stabilizers of claim 14, wherein there is a void between the respective left and right lumbar support member stabilizers.

* * * * *